US011639789B2

(12) United States Patent
Sharrah et al.

(10) Patent No.: US 11,639,789 B2
(45) Date of Patent: May 2, 2023

(54) PORTABLE LIGHT AND KEYED RECHARGEABLE USB BATTERY

(71) Applicant: STREAMLIGHT, INC., Eagleville, PA (US)

(72) Inventors: Raymond L. Sharrah, Collegeville, PA (US); Cleatis A. Eichelberger, East Norriton, PA (US); Thomas D. Boris, Collegeville, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 17/567,637

(22) Filed: Jan. 3, 2022

(65) Prior Publication Data

US 2022/0221143 A1 Jul. 14, 2022

Related U.S. Application Data

(60) Provisional application No. 63/136,900, filed on Jan. 13, 2021.

(51) Int. Cl.

| | |
|---|---|
| ***F21V 23/06*** | (2006.01) |
| ***F21L 4/08*** | (2006.01) |
| ***H01R 13/631*** | (2006.01) |

(52) U.S. Cl.

CPC ..... *F21V 23/06* (2013.01); *F21L 4/085* (2013.01); *H01R 13/631* (2013.01)

(58) Field of Classification Search

CPC ..... F21V 23/06; F21L 4/085; F21L 4/08

See application file for complete search history.

(56) References Cited

U.S. PATENT DOCUMENTS

| | | | |
|---|---|---|---|
| 3,705,983 | A | 12/1972 | Yamada |
| 4,114,187 | A | 9/1978 | Uke |

(Continued)

FOREIGN PATENT DOCUMENTS

| | | |
|---|---|---|
| CN | 201696874 | 1/2011 |
| CN | 204785598 | 11/2015 |

(Continued)

OTHER PUBLICATIONS

AmpTorrent, "USB Rechargeable AA Batteries Lithium 2960mWh High Capacity, 1.5V Constant Output, 2 Hours Fast Charging Batteries 4 Pack with 4 in 1 Charging Cable", date first listed on Amazon—Dec. 17, 2019, 8 pages, https://www.amazon.com/dp/B082W2MP8Y/ref=sspa_dk_detail_4?psc=1&pd_rd_i=B082W2MP8Y&pd_rd_w=GrP2n&pf_rd_p=48d372c1-f7e1-4b8b-9d02-4bd86f5158c5&pd_rd_wg=uFbVU&pf_rd_r=NR7ZXXCG7KY55DHT35E0&pd_rd_r=3a94fcaa-1876-4d7d-b441-0d74daf917d7&spLa=ZW5jcnlwdGVkUXVhbGlmaWVyPU EyOE1XUVJQNEMzNTNXJmVuY3J5cHRizElkPUEwODY1NzQ0MkMOUDQxR0hJRUdDTyZlbmNyeXB0ZWRBZElkPUEwMTYwMzE5Mlg1SIBBOEEwMzVVSSZ3aWRnZXROYW1IPXNwX2RldGFpbCZhY3Rpb249Y2xpY2tSZWRpcmVjdCZkb05vdExvZ0NsaWNrPXRydWU.

(Continued)

*Primary Examiner* — Anabel Ton

(74) *Attorney, Agent, or Firm* — Clement A. Berard, Esq.; Dann, Dorfman, Herrell & Skillman, PC

(57) ABSTRACT

A portable light may comprise: a light body having an internal cavity configured to receive a rechargeable power source, having a keying feature, and having an opening through an exterior wall in a predetermined location relative to the keying feature; and a light source. A rechargeable power source has a charging connector and a keying feature in predetermined locations that when the keying feature thereof engages the keying feature of the internal cavity, the (Continued)

charging connector thereof is aligned with the opening through the exterior wall of the light body. Thus an external source of charging power can be connected through the opening in the exterior wall directly to the charging connector of the rechargeable power source for recharging the rechargeable power source while it is in the portable light.

33 Claims, 16 Drawing Sheets

(56) References Cited

U.S. PATENT DOCUMENTS 4,224,383 A 9/1980 Taylor
4,357,648 A 11/1982 Nelson
4,382,220 A 5/1983 Marshall et al.
5,019,767 A 5/1991 Shirai et al.
D324,430 S 3/1992 Sharrah et al.
5,160,879 A 11/1992 Tortola et al.
5,220,269 A 6/1993 Chen et al.
D344,358 S 2/1994 Yuen
5,432,689 A 7/1995 Sharrah et al.
5,558,430 A 9/1996 Booty, Jr.
5,605,394 A 2/1997 Chen
D380,858 S 7/1997 Sharrah et al.
D381,812 S 8/1997 Sharrah et al.
5,709,964 A 1/1998 Christensen et al.
D405,202 S 2/1999 Fattori et al.
5,871,272 A 2/1999 Sharrah et al.
6,056,415 A 5/2000 Allred, III et al.
D427,702 S 7/2000 Sharrah et al.
D431,720 S 10/2000 Fortune
D435,676 S 12/2000 Squillante et al.
D435,922 S 1/2001 Shing
RE37,092 E 3/2001 Sharrah et al.
D445,931 S 7/2001 Shiu
D447,587 S 9/2001 Poon
6,474,837 B1 11/2002 Belliveau
D477,680 S 7/2003 Petzl
D481,816 S 11/2003 Sharrah
D482,472 S 11/2003 Shiu
D482,473 S 11/2003 Shiu
D482,811 S 11/2003 Petzl
D485,384 S 1/2004 Poon
D495,819 S 9/2004 Krieger
6,905,223 B2 6/2005 Halasz
D508,140 S 8/2005 Sharrah
6,953,260 B1 10/2005 Allen
D521,170 S 5/2006 Craft et al.
D521,666 S 5/2006 Chean
D521,667 S 5/2006 Chean
D525,734 S 7/2006 Shiao
D527,476 S 8/2006 Craft
D529,213 S 9/2006 Shiu
7,101,057 B2 9/2006 Parker et al.
D530,438 S 10/2006 Maglica
D531,746 S 11/2006 Zhu
D532,138 S 11/2006 Wang et al.
D532,537 S 11/2006 Shiu
D532,538 S 11/2006 Yuen
D532,543 S 11/2006 Julius et al.
D534,289 S 12/2006 Shiu
D536,115 S 1/2007 Shiu
7,192,165 B2 3/2007 Petzl et al.
D541,454 S 4/2007 Galey
7,226,190 B2 6/2007 Petzl et al.
D548,863 S 8/2007 Shiu
D549,369 S 8/2007 DeBrunner
D549,379 S 8/2007 Sharrah et al.
D552,775 S 10/2007 Shiu
D553,277 S 10/2007 Ho et al.
D553,282 S 10/2007 Zhu
D557,838 S 12/2007 Shiu
D557,840 S 12/2007 Shiu
D557,842 S 12/2007 Lee
D560,008 S 1/2008 Poon
D560,009 S 1/2008 Spartano et al.
D564,116 S 3/2008 Linardos
D565,770 S 4/2008 Shiu
D566,309 S 4/2008 Kornfeld et al.
D568,509 S 5/2008 Shiu
D568,515 S 5/2008 Liu
D572,395 S 7/2008 Guelzow et al.
D574,982 S 8/2008 Lau
7,410,272 B2 8/2008 Halasz
D576,757 S 9/2008 Hesse et al.
D577,845 S 9/2008 Shiu
D578,236 S 10/2008 Dalton
D586,025 S 2/2009 Bonis
D586,489 S 2/2009 Shiu
D595,440 S 6/2009 Rivera et al.
D603,988 S 11/2009 Sharrah
D603,989 S 11/2009 Gardner et al.
D622,428 S 8/2010 Crawford
7,806,555 B2 10/2010 Liu
7,824,063 B2 11/2010 Frick
D629,542 S 12/2010 Robinson
D629,544 S 12/2010 Deguglimo et al.
D629,940 S 12/2010 Osterhout
7,926,971 B2 4/2011 West et al.
D643,561 S 8/2011 Maglica
D647,232 S 10/2011 Liu
D647,654 S 10/2011 Li
RE42,945 E 11/2011 Sharrah et al.
8,066,402 B2 11/2011 Klipstein
D655,027 S 2/2012 Milz et al.
8,148,912 B2 4/2012 Kim
D668,806 S 10/2012 Chapman et al.
D674,746 S 1/2013 Zhang
D674,943 S 1/2013 Sheikh et al.
D675,358 S 1/2013 Brands et al.
D676,992 S 2/2013 Trude
8,425,078 B2 4/2013 Matthews et al.
D682,451 S 5/2013 Hardy
D683,877 S 6/2013 Brands et al.
D685,940 S 7/2013 Lee
D688,402 S 8/2013 Roshak et al.
D690,855 S 10/2013 Araujo
8,545,069 B2 10/2013 McClaslin et al.
D698,961 S 2/2014 Dalton
8,727,561 B2 5/2014 Sharrah et al.
D707,868 S 6/2014 Lee
8,779,683 B2 7/2014 Snyder et al.
8,807,781 B2 8/2014 Weber
D723,201 S 2/2015 Windom
D729,426 S 5/2015 Dalton
D733,951 S 7/2015 Kent
D734,518 S 7/2015 Zimmermann
D750,823 S 3/2016 Sharrah et al.
9,341,325 B2 5/2016 Sharrah et al.
D765,295 S 8/2016 McLennan
9,515,419 B2 12/2016 Inskeep
9,651,208 B2 5/2017 Sharrah et al.
D788,965 S 6/2017 Roshak et al.
9,843,208 B2 12/2017 Inskeep
D810,337 S 2/2018 Eichelberger
D833,334 S 11/2018 Takayanagi; Mika
D844,557 S 4/2019 Wang; Kunli
10,302,291 B2 5/2019 Parsons
D856,274 S 8/2019 Ebrahimi Afrouzi
D861,215 S 9/2019 Sharrah et al.
D867,069 S 11/2019 Wang
10,578,297 B1 * 3/2020 Zhu ..... F21L 4/027
10,605,418 B2 3/2020 Chen et al.
10,670,253 B1 6/2020 Lemon et al.
10,711,953 B1 * 7/2020 Zhu ..... F21V 23/009
D907,825 S 1/2021 McLennan
D940,369 S 1/2022 McLennan
D940,936 S 1/2022 Sharrah et al.
D940,937 S 1/2022 Sharrah et al.
D941,751 S 1/2022 Boris
D949,095 S 4/2022 Boris
2005/0225969 A1 10/2005 Chen
2005/0231155 A1 10/2005 Huang

(56) References Cited

U.S. PATENT DOCUMENTS

| | | | | |
|---|---|---|---|---|
| 2005/0276042 | A1 | 12/2005 | Ho | |
| 2006/0193127 | A1 | 8/2006 | Kumthampinij | |
| 2006/0214630 | A1 | 9/2006 | Huang | |
| 2007/0064354 | A1 | 3/2007 | West | |
| 2007/0278995 | A1 | 12/2007 | Batdorff et al. | |
| 2009/0168407 | A1 | 7/2009 | Wright | |
| 2009/0323344 | A1 | 12/2009 | Crawford | |
| 2010/0190052 | A1 | 7/2010 | Rajani et al. | |
| 2010/0195321 | A1 | 8/2010 | Sharrah et al. | |
| 2010/0219775 | A1 | 9/2010 | Maglica et al. | |
| 2010/0320967 | A1 | 12/2010 | Sa | |
| 2011/0216529 | A1 | 9/2011 | Weng | |
| 2012/0033416 | A1 | 2/2012 | Ballard | |
| 2013/0343042 | A1 | 12/2013 | Windom | |
| 2014/0036485 | A1 | 2/2014 | Parsons | |
| 2014/0268713 | A1* | 9/2014 | Unger | F21S 9/02 362/205 |
| 2014/0347249 | A1 | 11/2014 | Bourilkov | |
| 2015/0003050 | A1* | 1/2015 | Parsons | H05B 45/3725 362/158 |
| 2015/0140379 | A1 | 5/2015 | Yau | |
| 2015/0212315 | A1 | 7/2015 | Specht | |
| 2018/0120386 | A1 | 5/2018 | Riemer | |
| 2018/0123175 | A1 | 5/2018 | Riemer | |
| 2022/0252231 | A1* | 8/2022 | Wang | F21L 4/085 |

FOREIGN PATENT DOCUMENTS

| | | |
|---|---|---|
| CN | 205579251 | 9/2016 |
| CN | 206112611 | 4/2017 |
| CN | 206159882 | 5/2017 |
| CN | 305522811 | 12/2019 |
| CN | 210141575 | 3/2020 |
| CN | ZL202030290603.6 | 2/2021 |
| DE | 283441 | 4/1915 |
| DE | 8515726 | 8/1985 |
| EM | 008036818-0001 | 7/2020 |
| EP | 0111818 | 6/1984 |
| EP | 1588094 | 3/2008 |
| FR | 2745627 | 9/1997 |
| FR | 2850448 | 1/2006 |
| GB | 2264164 | 8/1993 |
| KR | 200339019 | 1/2004 |
| KR | 300577436 | 11/2010 |
| KR | 301042532 | 1/2020 |
| WO | 2001/057431 | 8/2001 |
| WO | 2004/070268 | 8/2004 |
| WO | 2018/068325 | 4/2018 |

OTHER PUBLICATIONS

Delipow, "AA Rechargeable Batteries,USB 1.5V Lithium Rechargeable Batteries, High Capacity 2800mWh Li-ion AA Battery, 1 H Quick Charge , 1200 Cycles with USB Cable—4 Pack", earliest date reviewed on Amazon—Jun. 9, 2019, 8 pages, https://www.amazon.com/dp/B07QV55YH9/ref=sspa_dk_detail_3?pd_rd_i=B07QV55YH9&pd_rd_w=xJHlk&pf_rd_p=48d372c1-f7e1-4b8b-9d02-4bd86f5158c5&pd_rd_wg=pYtaZ&pf_rd_r=W6ADKPA2F4R7BX81SFPD&pd_rd_r=366aacc6-9e8f-4453-82bc-e106954483db&spLa=ZW5jcnlwdGVkUXVhbGlmaWVyPUFRUzhPU1VIQ0czRFQmZW5jcnlwdGVkSWQ9QTA5NTI2OTMxOTkwM0IQQkM5N1M2JmVuY3J5cHRIZEFkSWQ9QTAzMDczNDIHNEZWWFBBNE9OV1Amd2lkZ2V0TmFtZT1zcF9kZXRhaWwmYWN0aW9uPWNsaWNrUmVkaXJIY3QmZG9Ob3RMb2dDbGljaz10cnVl&th=1.

Fuvaly, "Usb Rechargeable Lithium AAA Batteries Triple A Li-ion Battery with Micro USB Charging Cable 1.5V 450mAh 1h Quick-Charge FUVALY (4pack)", date first listed on Amazon—Apr. 18, 2019, 7 pages, https://www.amazon.com/Rechargeable-Batteries-Charging-Quick-Charge-Fuvaly/dp/B07QW531W2?th=1.

"Anker PowerCore 5000 Portable Charger, Ultra-Compact 5000mAh External Battery with Fast-Charging Technology, Power Bank for iPhone, iPad, Samsung Galaxy and More", first available Mar. 11, 2016. Amazon.com, [https://www.amazon .com/Anker-PowerCore-Ultra-Compact-High-Speed-Technology/dp/B01CU1EC6Y?source=ps-sl-shoppingads-Ipcontext&psc= 1].

"Strearnlight 18650 USB Battery (2 Pack)", first accessed Jul. 8, 2021. TacticalGear.com [https://tacticalgear.com/streamlight-18650-usb-battery-2-pack-black?searchterm=streamlight%20 18650].

"SureFire 18650 Li-Ion Rechargeable Battery with Charging Port (3.6V, 3500mAh)", first accessed May 17, 2021. BHPhotoVideo.com [https://www.bhphotovideo.com/c/product/1456473-REG/surefire_sf18650b_18650_rechargeable_lithium_ion_battery.html/overview?ap =y&smp=y].

Streamlight, Inc., "Protac® Rail Mount 1—Dual Fuel Tactical Long Gun Light", printed Nov. 4, 2021, 2 pages, https://www.streamlight.com/en/products/detail/index/protac-rail-mount-1.

Streamlight, Inc., "Protac® Rail Mount 1—Dedicated Fixed-Mount, Dual Fuel Tactical Long Gun Light", Data sheet, © 2016, Jan. 2016, 1 page.

Streamlight, Inc., "Protac® Rail Mount 2—Waterproof Tactical Long Gun Light with 625 Lumens", printed Nov. 4, 2021, 2 pages, https://www.streamlight.com/products/detail/index/protac-rail-mount-2.

Streamlight, Inc., "Protac® Rail Mount 2—Dedicated Fixed-Mount, Dual Fuel Tactical Long Gun Light", Data sheet, © 2016, Jan. 2016, 1 page.

Streamlight, Inc., "Protac® HL USB—USB Rechargeable, 1000 Lumen Tactical Flashlight", printed Nov. 12, 2021, 2 pages, https://www.streamlight.com/en/products/detail/index/protac-hl-usb.

Streamlight, Inc., "Protac® HL USB—USB Rechargeable, High Lumen Tactical Light", Data sheet, © 2021, Jan. 2021, 1 page.

Streamlight, Inc., "Protac® HL-X / Protac® HL-X USB—USB—Multi-Fuel 1000 Lumen Tactical Flashlight", printed Nov. 12, 2021, 2 pages, https://www.streamlight.com/en/products/detail/index/protac-hl-x.

Streamlight, Inc., "Protac® HL-X USB / Protac® HL-X—Multi-Fuel, High Lumen Tactical Light", Data sheet, © 2020, Apr. 2020, 1 page.

Streamlight, Inc., "Protac® HL 5-X—3500 Lumen Tactical Flashlight with Multi-Fuel Options", printed Nov. 12, 2021, 2 pages, https://www.streamlight.com/en/products/detail/index/protac-hl-5-x.

Streamlight, Inc., "Protac® HL 5-X / Protac® HL 5-X USB—Multi-Fuel, High Lumen Tactical Light", Data sheet, © 2020, Apr. 2020, 1 page.

Streamlight, Inc., "Protac® HL—High 750 Lumen Tactical Flashlight", printed Nov. 12, 2021, 2 pages, https://www.streamlight.com/en/products/detail/index/protac-hl.

Streamlight, Inc., "Protac® HL—High Lumen Lithium Tactical Flashlight", Product Fact sheet, document #215, Issued: Jan. 6, 2012, Revised Jul. 17, 2017, Rev 6, 1 page.

Streamlight, Inc., "Protac® 1L-1AA—Super Bright Dual Fuel Tactical Flashlight", printed Nov. 12, 2021, 2 pages, https://www.streamlight.com/en/products/detail/index/protac-1l-1aa.

Streamlight, Inc., "Protac® 1L-1AA—Dual Fuel Everyday Carry Light", Data sheet, © 2018, Jun. 2018, 1 page.

Streamlight, Inc., "Protac® 1L—Tactical Handheld Flashlight", printed Nov. 12, 2021, 2 pages, https://www.streamlight.com/en/products/detail/index/protac-1l.

Streamlight, Inc., "Protac® 1L—High Performance Lithium Flashlight", Data sheet, © 2017, Jan. 2017, 1 page.

Streamlight, Inc., "Protac® 2L—Super Bright Tactical Flashlight", printed Nov. 15, 2021, 2 pages, https://www.streamlight.com/en/products/detail/index/protac-2l.

Streamlight, Inc., "Protac® 2L—High Performance Lithium Flashlight", Data sheet, © 2017, Jan. 2017, 1 page.

Streamlight, Inc., "Protac® 2AA—Tactical Handheld Flashlight", printed Nov. 15, 2021, 2 pages, https://www.streamlight.com/en/products/detail/index/protac-2aa.

Streamlight, Inc., "Protac® 2AA—High Performance Alkaline Flashlight", Data sheet, © 2018, Jun. 2018, 1 page.

(56) References Cited

OTHER PUBLICATIONS

Streamlight, Inc., "Protac® 1AAA—Handheld Tactical Flashlight", printed Nov. 15, 2021, 2 pages, https://www.streamlight.com/en/products/detail/index/protac-1aaa.
Streamlight, Inc., "Protac® 1AAA—Ultra Compact Tactical Light", Data sheet, © 2017, Apr. 2017, 1 page.
Streamlight, Inc., "Protac® 2AAA—Everyday Carry Handheld Flashlight", printed Nov. 15, 2021, 2 pages, https://www.streamlight.com/en/products/detail/index/protac-2aaa.
Streamlight, Inc., "Protac® 2AAA—High Performance Alkaline Flashlight", Data sheet, © 2017, Apr. 2017, 1 page.
Streamlight, Inc., "Microstream® USB—Rechargeable, Bright Small LED Flashlight", printed Nov. 15, 2021, 2 pages, https://www.streamlight.com/en/products/detail/index/microstream-usb.
Streamlight, Inc., "Microstream® USB—Ultra Compact, USB Rechargeable, Personal Light", Data sheet, © 2018, Nov. 2018, 1 page.
Streamlight, Inc., "Macrostream® USB—Rechargeable, Super Bright Small LED Flashlight", printed Nov. 15, 2021, 2 pages, https://www.streamlight.com/en/products/detail/index/macrostream-usb.
Streamlight, Inc., "Macrostream® USB—Compact, USB Rechargeable, Personal Light", Data sheet, © 2020, Jan. 2020, 1 page.
Streamlight, Inc., "Protac® 2L-X / Protac® 2L-X USB—Multi-Fuel Tactical Flashlight with 500 Lumens", printed Nov. 15, 2021, 2 pages, https://www.streamlight.com/en/products/detail/index/protac-2l-x.
Streamlight, Inc., "Protac® 2L-X USB / Protac® 2L-X—Multi-Fuel, High Performance Tactical Light", Data sheet, © 2020, Apr. 2020, 1 page.
Streamlight, Inc., "Protac® HPL USB—Super Bright, Tactical Long-Range Flashlight with 1000 Lumens", printed Nov. 15, 2021, 2 pages, https://www.streamlight.com/en/products/detail/index/protac-hpl-usb.
Streamlight, Inc., "Protac® HPL USB—Long-Range, High Candela USB Rechargeable Tactical Light", Data sheet, © 2018, Jan. 2018, 1 page.
Streamlight, PT Series Professional Tactical Lights, 2 pages, Feb. 2010.
Streamlight, NightFighter LED Flashlight, 1 page, Sep. 2009.
Streamlight, "Argo Luxeon Headlamp," http://www.streamlight.com/argo_info.htm, Printed Oct. 18, 2004, 2 Pages.
Streamilght, "Argo Luxeon Headlamp Specifications," http://www.streamlight.com/argo_spec.htm, Printed Oct. 18, 2004, 1 Page.
Streamlight, "Wow Parts & Accessories," http://www.streamlight.com/wow_accessories.htm, Printed Oct. 18, 2004, 1 Page.
Streamlight, "Wow Specifications," http://www.streamlight.com/wow_specifications.htm, Printed Oct. 18, 2004, 1 Page.
Streamlight, "TopSpot II Specifications," http://www.streamlight.com/topspot_2_specifications.htm, Printed Oct. 18, 2004, 1 Page.
Stream Light, "TopSpot II Parts & Accessories," http://www.streamlight.com/topspot_2_accessories.htm, Printed Oct. 18, 2004, 1 Page.
Streamlight, "Septor Information," http://www.streamlight.com/septor_info.htm, Printed Oct. 21, 2004, 2 Pages.
Streamlight, "Septor Specifications," http://www.streamlight.com/septor_spec.htm, Printed Oct. 21, 2004, 1 Page.
Streamlight, "Trident Information," http://www.streamlight.com/trident_info.htm, Printed Oct. 21, 2004, 2 Pages.
Streamlight, "Trident Specifications," http://www.streamlight.com/trident_spec.htm, Printed Oct. 21, 2004, 1 Page.
Streamlight, "New Trident/New Septor/New ClipMate," LED Technology Meets Streamlight Quality, Sep. 2002, Pamphlet. #990633.
Streamlight, "New ARGO Luxeon LED Headlamp," Feb. 2004, Pamphlet.: #990661.
Streamlight, TL-2 L Shock-Proof Flashlight, 2 pages, Aug. 2007.
Streamlight, TL-3 LED Flashlight, 2 pages, Aug. 2007.
Streamlight, Tactical Hand-Held Series, 4 pages, 2010.
Streamlight, Inc., "ProTac HL—High Lumen Tactical Light", printed Jun. 18, 2012, 5 pages, www.streamlight.com/product/product.aspx?pid=254.
Streamlight, Stylus Pro Alkaline Battery-Powered LED Pen Light, 1 page, Apr. 2007.
Streamlight, Stylus Series, Stylus Pro, www.streamlight.com/product/product, 4 pages, 2010.
Streamlight, Product Fact Sheet, Streamlight Stylus Pro LED Flashlight, 1 page, Nov. 2007, 2008.
Streamlight, Polystylus Ultra-Tough Fiberglass Penlight, 2 pages, Feb. 2009.
Streamlight, Stylus Series, PolyStylus, www.streamlight.com/product/product.. 4 pages, Mar. 15, 2010.
Energizer, Lighting products, 3 sheets, 2010.
Eveready Industries India Ltd., "Flashlights—digiLED Torches", 2 pages, © 2009, http://www.evereadyindustries.com/business/flashlights/led-torches.asp.
Eveready Industries India Ltd., "Flashlights—Aluminium & Plastic Torches", 2 pages, © 2009, http://www.evereadyindustries.com/business/flashlights/aluminium-plastic.asp.
4Sevens, "Products meeting the search criteria ['quark']" and pages for "Neutral White Quark $123^2$", "Neutral White Quark $AA^2$", and "Quark Regular Titanium Collector's Set", 23 pages, © 2010, http://www.4sevens.com/ . . . .
4Sevens, "Fenix Lights" and pages for "Fenix E20", "Fenix Digital LD10+", "Fenix Digital LD20+", "Fenix PD20+", and "Fenix PD30+ R4 Edition", 19 pages, © 2010, http://www.4sevens.com/ . . . .
Fenix Light, Fenix's Homepages: "New Products", and pages for "E21 Neutral White", "LD20 R4", "LD10 R4", "PD30 R4", "PD30", "LD20", "TK12", and "L Series", 46 pages, © 2007, http://www.fenixlight.com/ . . . .
Streamlight, Product Fact Sheet, 3AA HAZ-LO® Headlamp, Document #161, 1 page, Issued: Nov. 3, 2006, Revised: Nov. 21, 2019.
Streamlight, Product Fact Sheet, Argo® HAZ-LO®, Document #193, 1 page, Issued: Mar. 17, 2014, Revised: Apr. 7, 2017.
Streamlight, Product Fact Sheet, ARGO® LED Headlamp, Document #146, 1 page, Issued: Oct. 1, 2004, Revised: Apr. 7, 2017.
Streamlight, ENDURO® Ultra-Compact LED Headlamp, Datasheet, 1 page, © 2021, Sep. 2021.
Streamlight, ENDURO® Pro Low Profile High Performance Multi-Function Headlamp, Datasheet, 1 page, © 2018, Jan. 2018.
Streamlight, ENDURO® Pro USB USB Rechargeable Multi-Function Headlamp, Datasheet, 1 page, © 2019, Oct. 2019.
Streamlight, ENDURO® Pro HAZ-LO Low Profile Safety Rated Multi-Function Headlamp, Datasheet, 1 page, © 2019, Apr. 2019.
Streamlight, ENDURO® Pro HAZ-LO ATEX Low Profile Zone 0 Rated Multi-Function Headlamp, Datasheet, 1 page, © 2020, Jun. 2020.
Streamlight, Protac HL® Headlamp High Lumen Headlamp, Datasheet, 1 page, © 2016, Mar. 2016.
Streamlight, Protac HL® USB Headlamp High Lumen USB Rechargeable Headlamp, Datasheet, 1 page, © 2020, Apr. 2020.
Nitecore, "Nitecore TM10K", Copyright © 2007-2022 Nitecore printed Mar. 18, 2022, 11 pages, https://flashlight.nitecore.com/product/tm10k.
SYSMAX Innovations Co., Ltd., "Nitecore TM10K", Manual, date prior to Dec. 20, 2021, 2 pages.
Streamlight, Inc., "Wedge® Compact, Rechargeable, High-Performance EDC Flashlight", Data Sheet, © 2021, Jul. 2021, 1 page.
Streamlight, Inc., "4AA ProPolymer® LED Safety-Rated Led Flashlight with Long Runtime", printed Mar. 18, 2022, 2 pages, https://www.streamlight.com/en/products/detail/index/4aa-propolymer-led#.
Streamlight, Inc., "4AA ProPolymax® Long-Range High Lumen7" Polymer Flashlight, printed Mar. 18, 2022, 2 pages, https://www.streamlight.com/en/products/detail/index/4aa-propolymax.
Amazon.com, "Underwater Kinetics Sunlight SL4 eLED Flashlight", printed Mar. 18, 2022, 1 pages, https://www.amazon.com/Underwater-Kinetics-Sunlight-eLED-Flashlight/dp/B001G5ZGH0.
Optics Planet., "UK International Underwater Kinetics Sunlight SL4", printed Mar. 18, 2022, 4 pages, https://www.opticsplanet.com/uk-sunlight-s14.html.

(56) References Cited

OTHER PUBLICATIONS

Streamlight, Inc., "Wedge® Slim Everyday Carry Flashlight", printed Mar. 21, 2022, 2 pages, https://www.streamlight.com/en/products/detail/index/wedge.
Coast Products, "Rechargeable Pure Beam Focusing Coast Crew PX1R", © 2019-2022 Coast Products, captured on Mar. 24, 2022, 9 pages, https://coastportland.com/products/coast-crew-px1r.
Coast Products, "Zithion-X Micro-USB Rechargeable ZX450 Rechargeable Battery", © 2019-2022 Coast Products, captured on Mar. 24, 2022, 5 pages, https://coastportland.com/products/zx450?pr_prod_strat=copurchase&pr_rec_pid=1589501296712&p.
Streamlight, Inc., "SL-B26 Protected Li-Ion USB Rechargeable Battery Pack", captured on Mar. 24, 2022, 1 page, https://www.streamlight.com/en/products/detail/index/sl-b-26-usb-battery.
International Searching Authority, "PCT—International Search Report & Written Opinion", PCT/US2022/011090, dated Mar. 30, 2022, 12 pages.

* cited by examiner

PORTABLE LIGHT AND KEYED RECHARGEABLE USB BATTERY

This application claims the benefit and priority of U.S. Patent Application No. 63/136,900 entitled "PORTABLE LIGHT AND KEYED RECHARGEABLE USB BATTERY" that was filed on Jan. 13, 2021, which is hereby incorporated herein by reference in its entirety.

The present invention relates to a rechargeable portable light, and, in particular, to a rechargeable portable light including a rechargeable power source. The present invention also relates to a rechargeable power source with keying to the portable light.

Traditional rechargeable lights could be charged by being placed into a receptacle of a charging device wherein the light and the charging device had compatibly located electrical contacts of a charging interface or the rechargeable battery thereof could be charged by removing it from the light and placing it into a receptacle of a battery charging device. Some charging devices had plural charging receptacles, e.g., one for the light and another for the battery therefrom.

More recently, some rechargeable lights were outfitted with an externally accessible charging connector, e.g., a standard connector such as a coaxial connector or a USB connector mounted in the body of the light, to which a compatible connector of an external power source charging device or of a cable connected to an external power source could be connected for charging a rechargeable battery via conductors and/or other circuitry inside the light while the rechargeable battery was disposed inside the light.

With the more recent advent of rechargeable lithium batteries which require certain protective circuitry to protect the battery from overcharging and/or over discharging, at least a part of such battery protection circuitry began to be packaged with the lithium battery in a common package or container, e.g., an AA size container. Since this requires an electronic circuit board in the battery package, a charging connector accessible from outside the battery started to be provided, so that the battery could be removed from the light and connected to a charging source, e.g., to an external power pack or a computer via a coaxial or USB connector outside of the light, thereby providing convenience for the user.

For example, a type 18650 rechargeable lithium battery and the like have a cylindrical case, typically like a 1.5 VDC size AA battery, with electrically positive (+) and negative (−) terminals on respective opposite ends thereof, and may have a USB charging connector in the side thereof. Many if not all batteries of this sort have symmetrical cases, e.g., cylindrical cases, and so there is and cannot be a known orientation of the battery when placed in the light.

At around the same time, manufacturers of portable lights began to provide charging connectors on the portable light itself, so that an external charging source could be connected to the portable light, e.g., by a coaxial or a USB connector, for charging the battery via the circuitry of the light while the battery is inside the portable light. That, however, results in additional complexity and cost for lights that have such connectors, but it does enable the battery to be charged when it is in the light as well as when it is outside the light.

Applicant believes there may be a need for a portable light that can receive a rechargeable source of electrical power having a charging connector that will be in a known predetermined orientation relative to the light. Applicant believes that providing a rechargeable power source having a keying feature that will align with a complementary keying feature of a light will avoid that problem. Thus, the power source and the light are respectively oriented into a known predetermined orientation by the keying features so that an opening in the body of the portable light is aligned to permit directly connecting a charging connector from an external power source through the opening in the light body and into the charging connector of the rechargeable source of electrical power whilst the rechargeable source of electrical power is inside the light. This would allow the elimination of the charging connector and related elements that are part of the light itself in conventional lights, thereby to likely reduce the complexity and cost thereof.

In addition, it is also believed that it would be advantageous if portable lights having different configurations and/or uses are configured to operate using rechargeable sources of electrical power having a common configuration including a charging connector and keying features, whereby sources of electrical power of a predetermined configuration could be utilized in and interchanged between and among many different lighting products.

Accordingly, a portable light may comprise: a light body having an internal cavity configured to receive a rechargeable power source, having a keying feature, and having an opening through an exterior wall in a predetermined location relative to the keying feature; a light source; a rechargeable power source having a charging connector and a keying feature in predetermined locations that when the keying feature thereof engages the keying feature of the internal cavity, the charging connector thereof is aligned with the opening through the external wall; and an electrical switch for energizing the light source. Thus an external source of charging power can be connected through the opening directly to the charging connector of the rechargeable power source for recharging the rechargeable power source.

Further, a portable light may comprise: a light body having an internal cavity configured to receive a rechargeable battery, having a keying feature, and having an opening through an exterior wall in a predetermined location relative to the keying feature; a light source; a rechargeable battery having a charging connector and a keying feature in predetermined locations that when the keying feature thereof engages the keying feature of the internal cavity, the charging connector thereof is aligned with the opening through the external wall; and an electrical switch for energizing the light source. Thus an external source of charging power can be connected through the opening directly to the charging connector of the rechargeable battery for recharging the rechargeable battery.

In addition, a rechargeable power source for a portable light may comprise: a power source case including a rechargeable electrical cell therein; one or more electrical terminals on the power source case coupled to the electrical cell; a charging connector in a side of the power source case and coupled for charging the electrical cell; the power source case having a keying feature in a known predetermined location relative to the charging connector such that when the rechargeable power source is placed into a portable light with the keying feature of the rechargeable power source engaging a complementary keying feature of the portable light, the charging connector of the rechargeable power source will be aligned with an opening through an external wall of the portable light.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1:
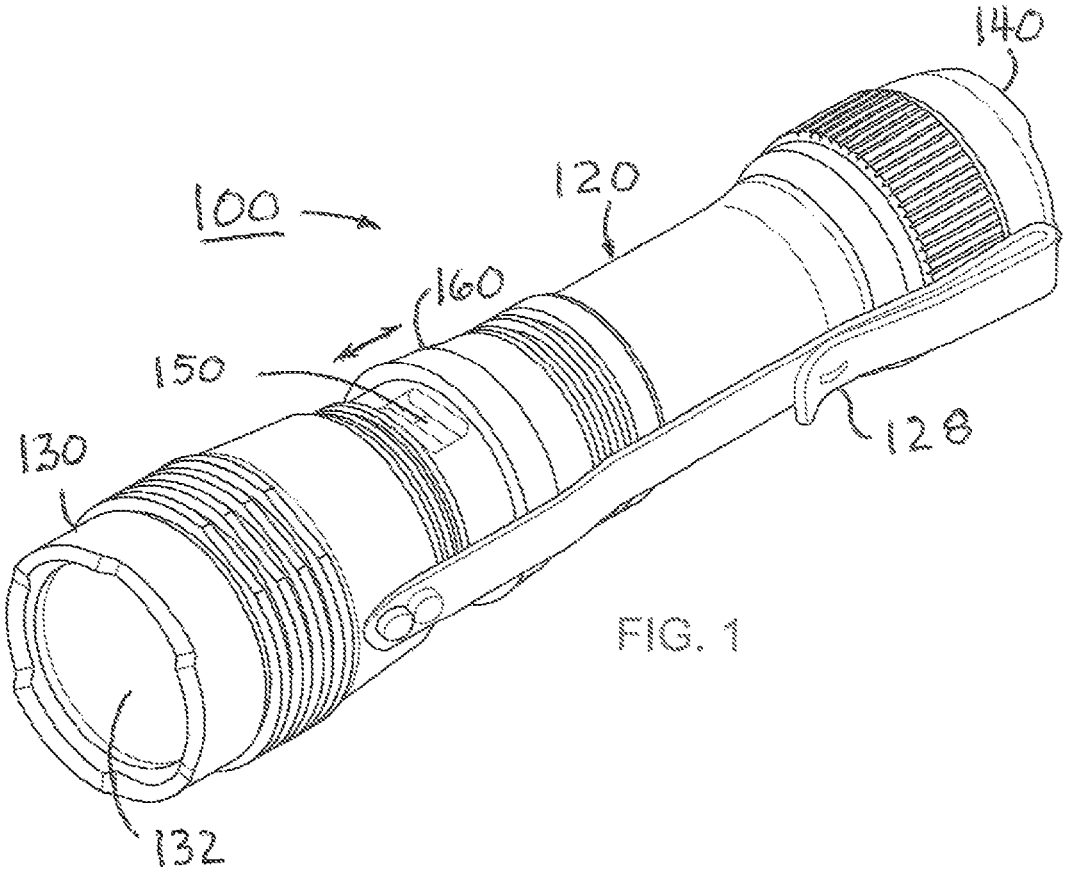
FIG. 1 is a perspective view of an example embodiment of a hand holdable portable light having an opening for connecting an external charging device directly to a charging connector of a rechargeable power source inside the example light.

In the Drawing, where an element or feature is shown in more than one drawing figure, the same alphanumeric designation may be used to designate such element or feature in each figure, and where a closely related or modified element is shown in a figure, the same alphanumerical designation may be primed or designated "a" or "b" or the like to designate the modified element or feature. Similar elements or features may be designated by like alphanumeric designations in different figures of the Drawing and with similar nomenclature in the specification. As is common, the various features of the drawing are not to scale, the dimensions of the various features may be arbitrarily expanded or reduced for clarity, and any value stated in any Figure is by way of example only.

DESCRIPTION OF THE PREFERRED EMBODIMENT(S)

Figure 1A:
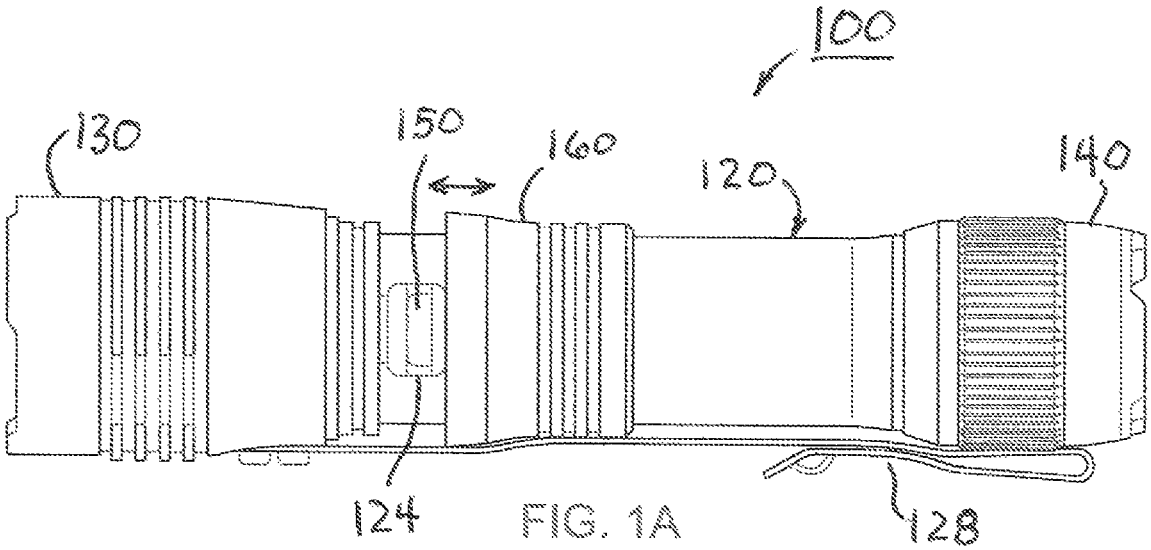
FIGS. 1A and 1B are side views of the example embodiment of such portable light.
Figure 1B:
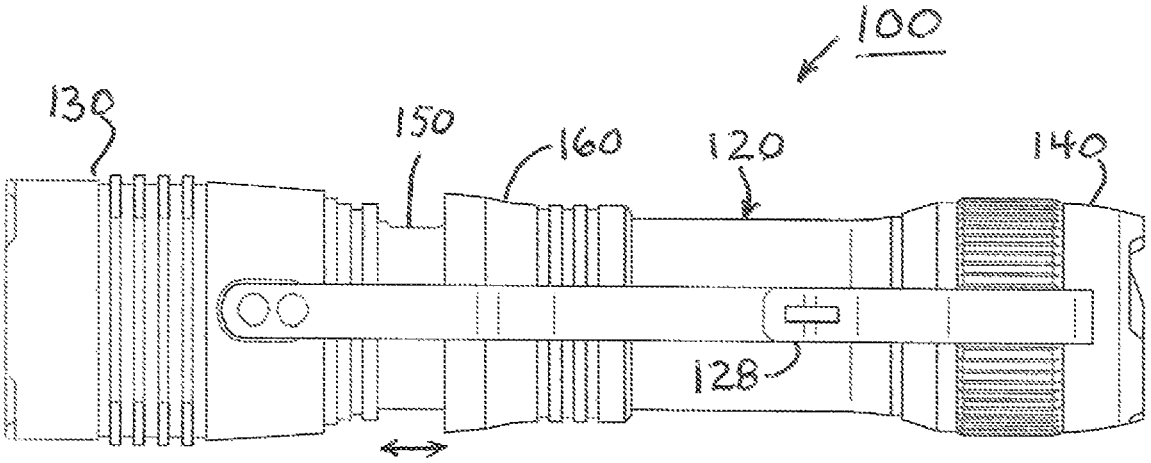
Figure 1C:
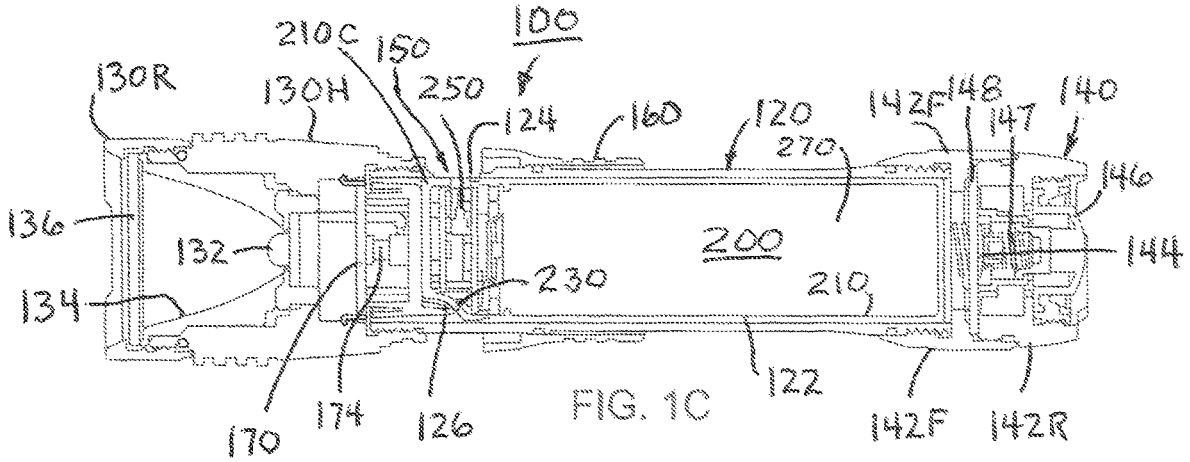
FIGS. 1C and 1D are cross-sectional views thereof.
Figure 1D:
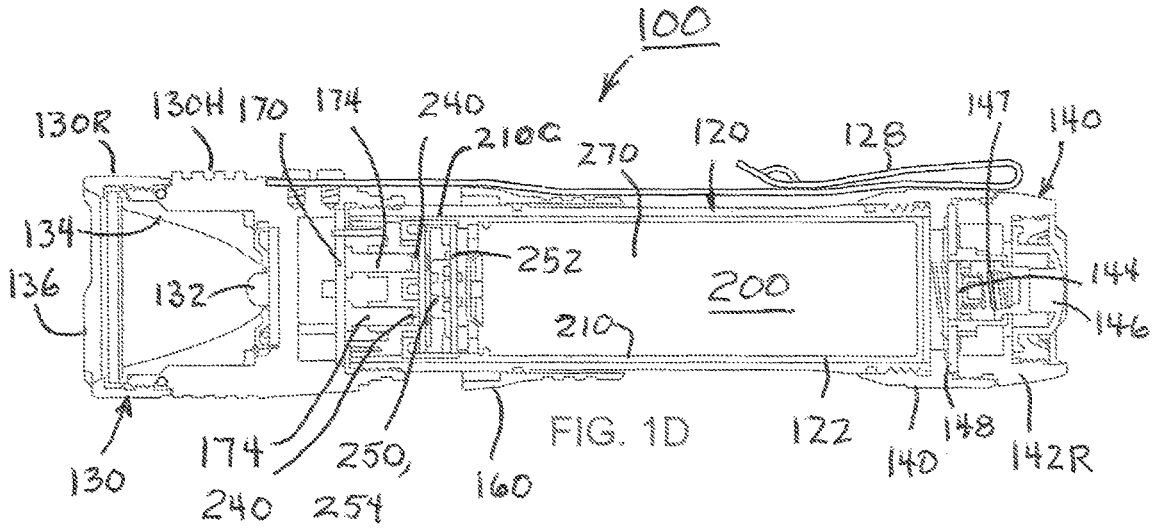
Figure 2A:
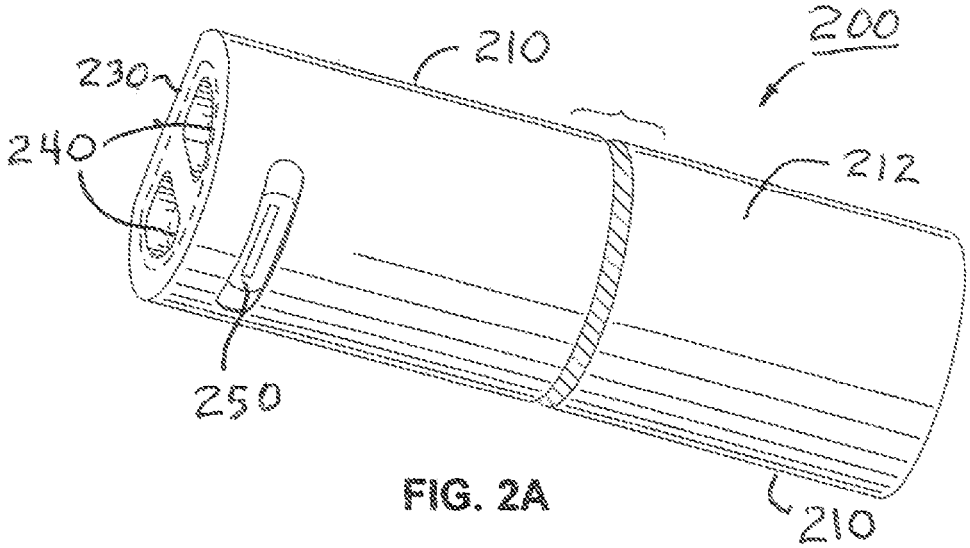
FIGS. 2A through 2H are two perspective views, four side views and two end views, respectively, of an example rechargeable source of electrical power suitable for use with the portable light of FIGS. 1-1D.
Figure 2B:
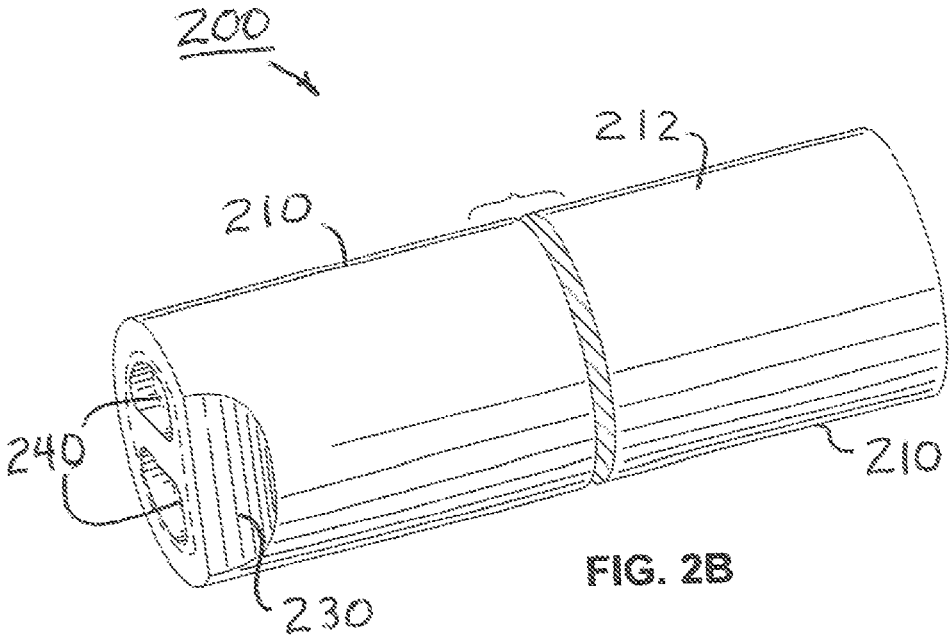
Figure 2C:
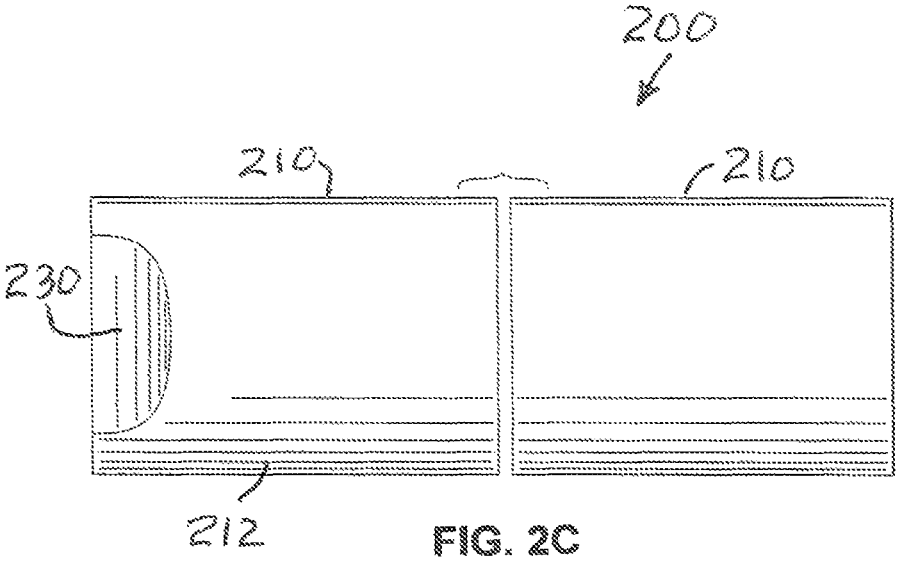
Figure 2D:
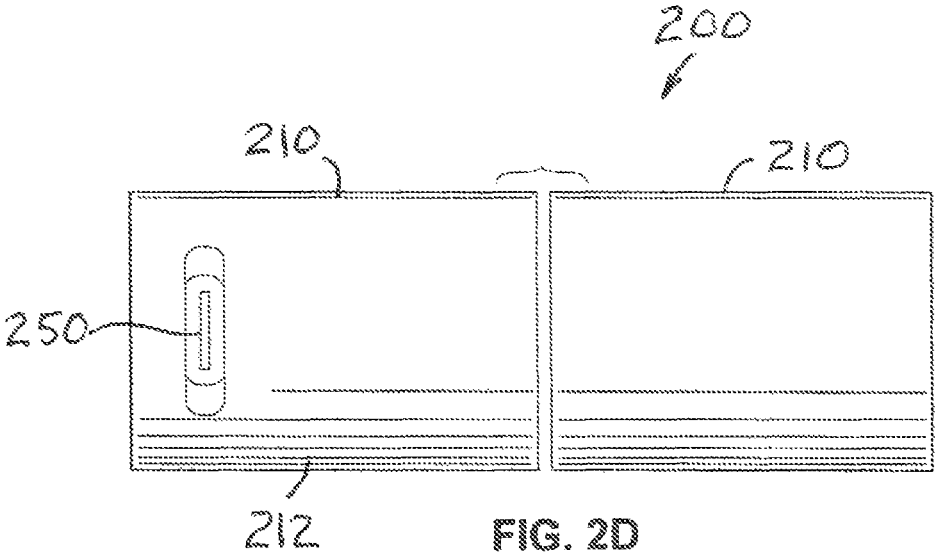
Figure 2E:
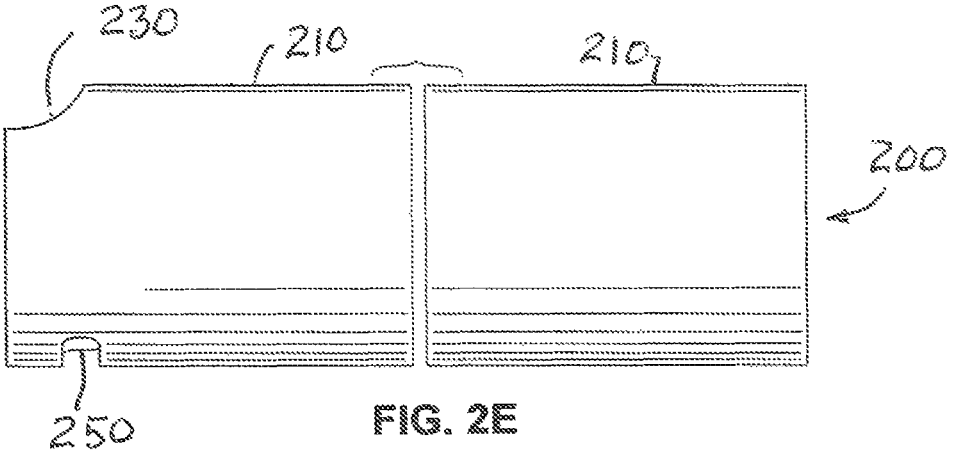
Figure 2F:
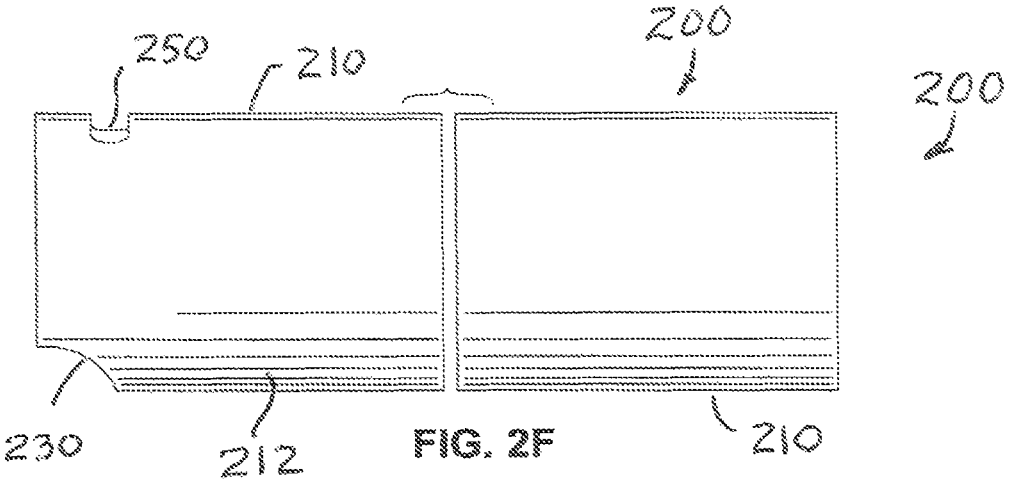
Figure 2G:
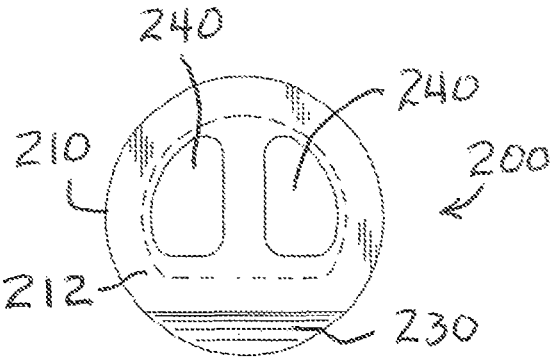
Figure 2H:
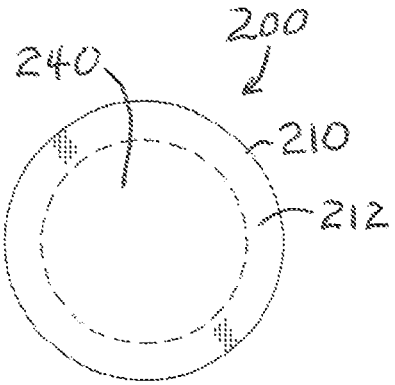
Figure 3A:
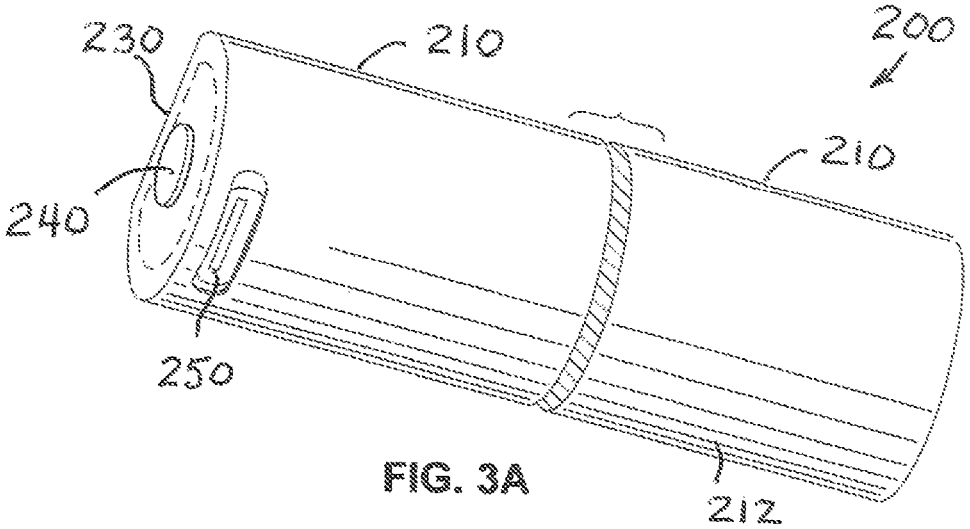
FIGS. 3A through 3H are two perspective views, four side views and two end views, respectively, of an example rechargeable source of electrical power suitable for use with the portable light of FIGS. 1-1D.
Figure 3B:
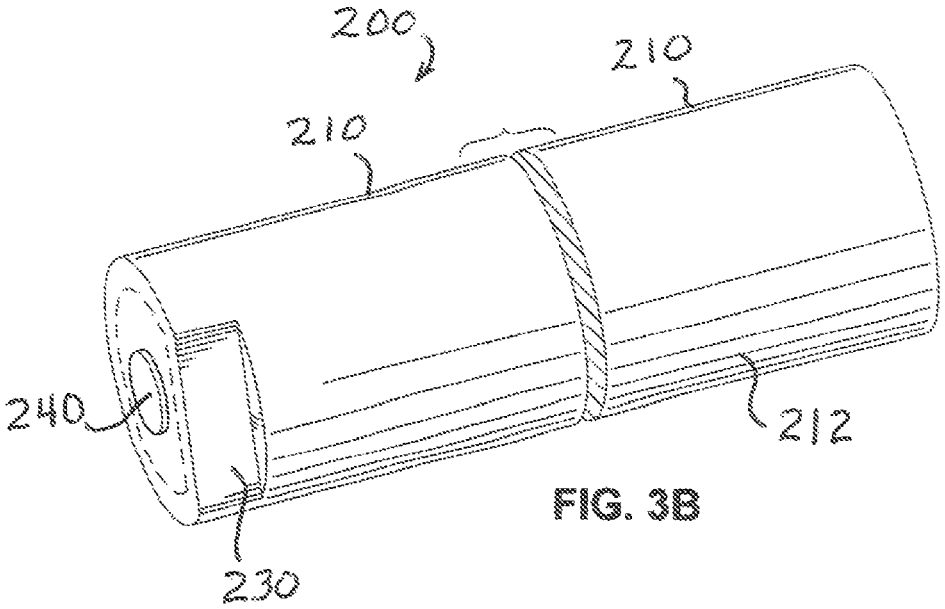
Figure 3C:
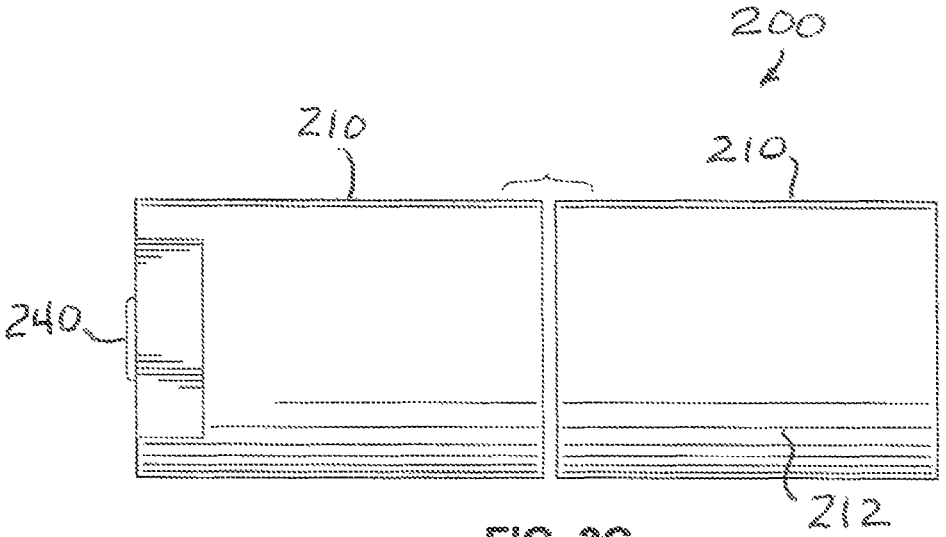
Figure 3D:
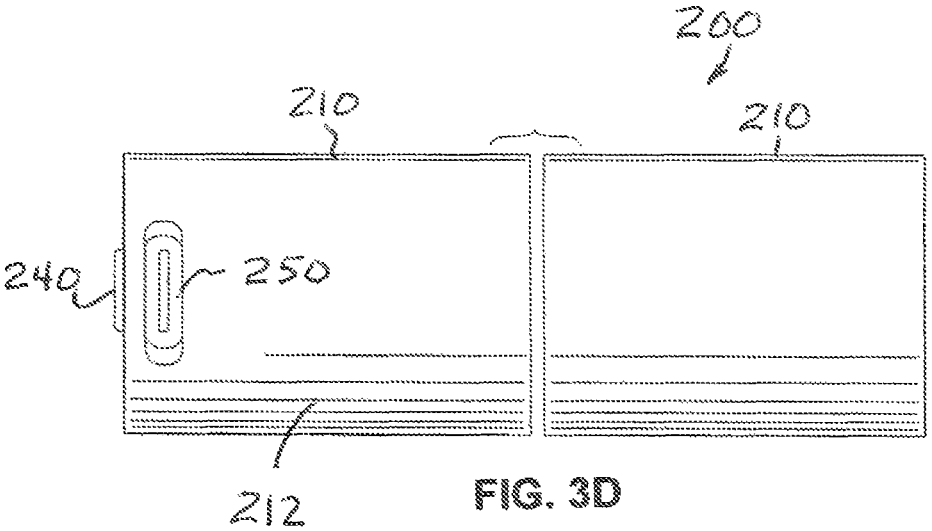
Figure 3E:
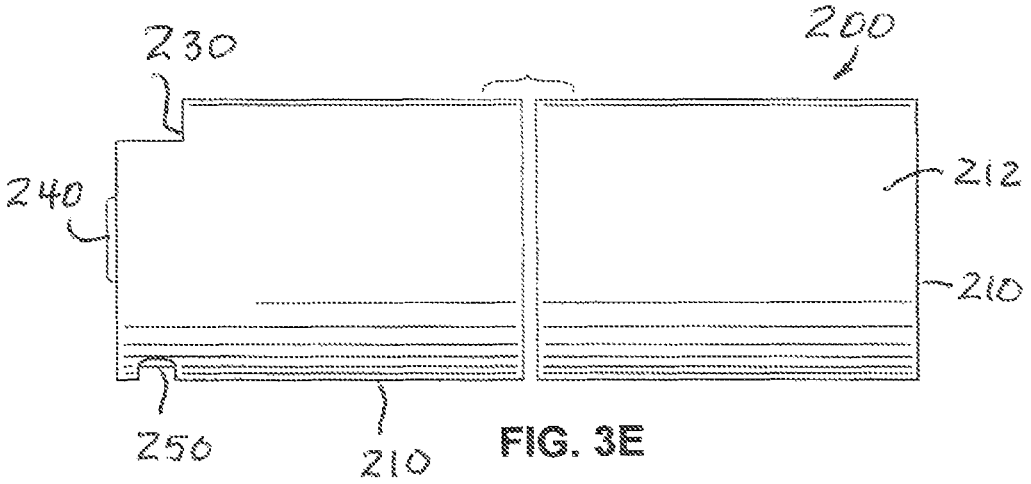
Figure 3F:
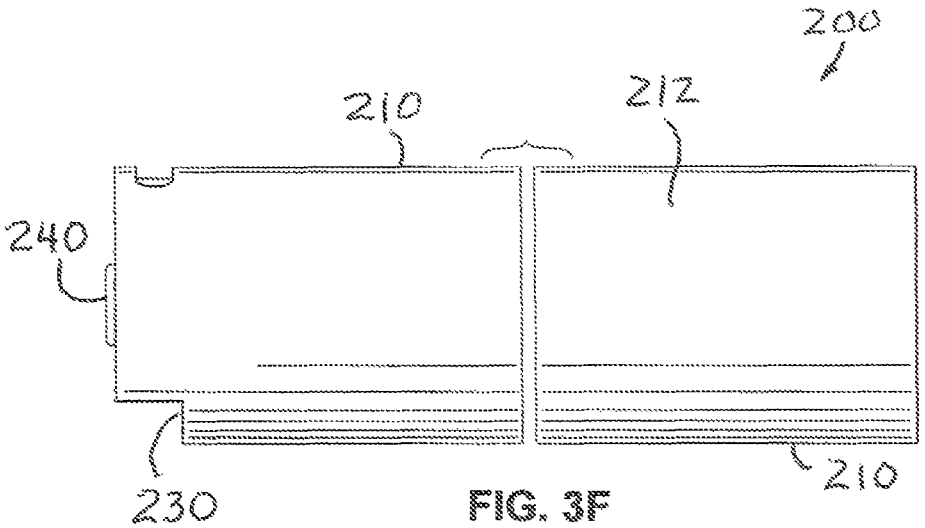
Figure 3G:
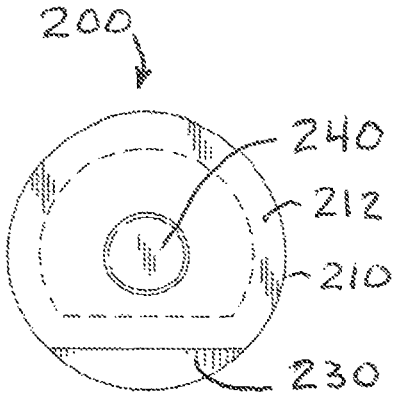
Figure 3H:
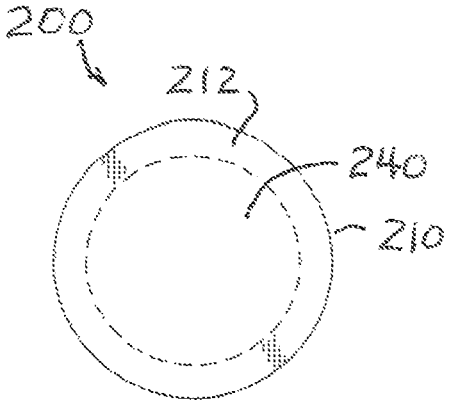

FIG. 1 is a perspective view of an example embodiment of a hand holdable portable light 100 having an opening 150 for connecting an external charging device directly to a charging connector of a rechargeable power source inside the example light, FIGS. 1A and 1B are side views of the example embodiment of such portable light 100, and FIGS. 1C and 1D are cross-sectional views thereof. Example portable light 100, e.g., a light configured to be holdable in a user's hand, is generally cylindrical in shape and has a cylindrical body 120 with a light head 130 including a light source at a forward end thereof and a tail cap 140 at a rearward end thereof. Lights with such configuration are commonly referred to as flashlights, although that term is often more broadly used. Light 100 has a charging port 150 whereat an external source of electrical power, e.g., an external charging device, may be connected for recharging the source of electrical power 200 of light 100.

Example light body 120 is tubular and has a cavity 122 therein in which a source of electrical power 200 is disposed for providing electrical power to energize the light source 132, e.g., a light emitting diode 132, of light head 130. Light body 120 is configured to receive light head 130 on one end thereof and to receive tail cap 140 on the other end thereof. Light body 120 has an opening 124 through an exterior wall thereof relating to charging port 150. Optionally, but preferably, a slidable collar 160 or cover 160 may be provided for sliding along light body 120 for covering and uncovering charging port 150, as indicated by the double ended arrow aside cover 160. Optionally, a clip 128 may be provided on light body 120.

Example light head 130 includes a head housing 130H that attaches to light body 120 and that contains the light source. Light source 132 is preferably a light emitting diode (LED) 136 that produces light when energized. Housing 130H also includes an optical element 134 disposed in front of LED 132 for forming the light produced thereby into a beam having desired characteristics. Optical element 134 may be a shaped reflector or may be a solid optical element, e.g., a totally internally reflective (TIR) optical element. A lens 136 covers the front face of light head 130 to reduce entry of dirt, debris and moisture into light head 130 and light 100.

Example light head 130 may have two parts, e.g., a main housing 130H and a lens retaining ring 130R retaining optical element 134 and lens 136 therein. Typically, one or more electronic circuit boards 170 are disposed in light 100, e.g., rearwardly in head housing 130 and/or forwardly in light body 120, as may be convenient, for controlling the application of electrical power from the electrical power source 200 thereof to light source 132 for energizing light source 132 to produce light in response to an electrical switch.

Example tail cap 140 includes a housing 142 in which is disposed an electrical switch 144 that can be actuated to open and close one or more electrical contacts thereof for controlling the operation of portable light 100, e.g., for energizing and de-energizing light source 132 thereof. A flexible actuator 146, e.g., a boot 146, may be provided to reduce entry of dirt, debris and moisture into tail cap 140 and light 100. Pressing and releasing flexible actuator 146 causes the actuation and de-actuation of electrical switch 144.

Example tail cap housing 142 may have plural parts, e.g., a rearward part 142R supporting boot 146 and a forward part 142F that supports rearward part 142R and attaches tail cap 140 to light body 120. Electrical switch 144 is disposed within housing parts 142F and 142R.

Example source of electrical power 200 includes an externally accessible charging port 250 to which an external source of charging power may be connected for charging and recharging power source 200 when it is in a device, e.g., portable light 100, not in a device. Typically, one example power source 200 includes a rechargeable battery 200, e.g., a rechargeable lithium battery 200, that has a symmetrical shape, e.g., a cylindrical shape, as do other common batteries. Because a symmetrical source of electrical power can be placed into a compatible cavity in different radial orientations, if a charging port 150 is provided thereon, then the charging port 150 thereof can be different radial positions relative to the cavity 122, i.e. the housing into which it is placed, and so would not necessarily align with the opening 124 in the light body 120.

Importantly, portable light 100 and power source 200 differ from other lights and power sources in that light 100 and power source 200 each have an asymmetrical feature, e.g., a keying feature, that is complementary to that of the other so that power source 200 may only be fully placed into cavity 124 of light 100 when their respective keying features are aligned and engaged. The respective keying features are complementary, e.g., one may be a recess while the other is a projection of similar size and shape, such that the projection keying feature fits into the recess keying feature. This can occur only when the power source 200 is in a predetermined radial orientation whereat the projection keying feature is aligned with the recess keying feature.

Keying feature 126 of light 100 is provided for cavity 122 of housing 120 thereof in a predetermined known position relative to opening 124 through housing 120, e.g., diametrically opposite opening 124, which also may be described as being 180 degrees radially around therefrom. Keying feature 230 of power source 200 is provided on housing 210 thereof in a predetermined known position relative to charging port 250 thereof, e.g., diametrically opposite charging port 250 which also may be described as being 180 degrees radially around therefrom.

Because each of the respective keying features 126, 230 are in complementary predetermined known positions relative to opening 124 and charging port 250, respectively, when keying features 126, 230 are engaged, power source 200 is in a known predetermined position in cavity 122 and light body 120 whereat charging port 250 of power source 200 is adjacent to and is aligned with opening 120 of light body 120, thereby to define an external charging port 150 of light 100. As a result, charging port 150 provides direct access to power source charging port 250 through opening 124 in light body 120 of light 100, whereby an external power source may be directly connected to power source 200, i.e. to charging port 250 thereof, through opening 124.

Even when power source 200 may include a symmetrical internal energy cell 270, e.g., a battery cell 270 or other cylindrical cell 270, case 210 or housing 210 of power source 200 has one or more asymmetrical external keying features 230 by which power source 200 may only be disposed in light body 120 in the one orientation in which charging port 250 thereof aligns with opening 124 to define the external charging port 150 of light 100.

FIGS. 2A through 2H are two perspective views, four side views and two end views, respectively, of an example rechargeable source of electrical power 200 suitable for use with the portable light 100 of FIGS. 1-1D; and FIGS. 3A through 3H are two perspective views, four side views and two end views, respectively, of an example rechargeable source of electrical power 200 suitable for use with the portable light 100 of FIGS. 1-1D.

Source of electrical power 200, or power source 200, e.g., often a rechargeable battery, e.g., preferably a rechargeable lithium battery according to present technology, and may include one or more electrical cells therein. Power source 200 typically includes an outer case 210, which may be the case of the power cell therein or a separate housing 210, and optionally a sleeve 212 there around which in the instance of a plural cell power source, may retain the plural cells in a desired physical configuration, e.g., end to end.

Power source 200 may have one or more external electrical contacts or terminals 240 for making electrical connections from the energy cell therein to external circuitry, e.g., to a load, such as a light source 132. In the example embodiment of FIGS. 2A-2H, two electrical terminals 240 are provided at one end of power source 200, and may be configured, e.g., recessed, to reduce the likelihood that accidental electrical contact may be made to or between them. Therein, and optionally, one of terminals 240 at the forward end of power source 200 may be electrically connected to a terminal 240 at the opposite or rearward end thereof, e.g., for which an electrically conductive housing 210 may provide an electrical connection. In the example embodiment of FIGS. 3A-3H, two electrical terminals 240 are provided at opposite ends of power source 200, and their separation tends to reduce the likelihood that accidental electrical contact may be made between them.

Typically, outer case 210 may be of an insulating material, e.g., a plastic sleeve, or may be of an electrical conductive material, e.g., a metal. In the example illustrated, power source 200 is generally cylindrical, as is common for such cells, except for keying feature 230. Outer sleeve 212 is typically an insulating sleeve to cover housing 210, particularly where housing 210 is an electrically conductive case 210. Typically, where outer case 210 is electrically conductive, it is connected to one of terminals 240, 240 and may be exposed at the end of power source 200 that is distal from the end thereof having terminals 240, e.g., by an opening in or area not covered by insulating sleeve 212 so that the distal end may be utilized as a terminal thereof.

Power source 200 has a keying feature 230, e.g., a squared off recess 230 or a curved recess 230, that makes power source 200 radially asymmetric. The keying feature of the rechargeable power source is, e.g., a recess defining a concave surface proximate an end of the rechargeable power source; or a recess defining two planar surfaces having an intersection that is transverse to a longer dimension of the rechargeable power source and is proximate an end of the rechargeable power source. Typically, but not necessarily, keying feature 230 is at the end of power source 200 having electrical terminals 240 which often, if not usually, is the end that is placed first into a light or other device to connect with electrical contacts at the far end of the cavity of the light or other device that it powers.

The keying feature 230 illustrated in FIGS. 2A-2F may be, e.g., defined as the shape of an intersection of a cylinder whose axis is transverse to a longitudinal axis of generally cylindrical power source 200 and is offset therefrom in a direction away from its charging port 250. The axis of the transverse cylinder may be outside the volume of power source 200. Thus charging port 250 and keying feature 230 are in known predetermined locations of cylindrical source 200, and the shape of keying feature 230 may be, e.g., a part of the surface of the transverse cylinder. In that example, those known predetermined locations include keying feature 230 and charging port 250 being radially opposite each other, e.g., radially 180° apart, and charging port 250 being in a known predetermined axial location by being a known predetermined axial distance from the end of source 200 at which keying feature 230 and terminals 240 are located.

Further, terminals 240 illustrated in FIGS. 2A-2F are also at respective known predetermined locations, e.g., being spaced apart on that end of power source 200 by a known predetermined distance and being on opposite sides thereof, e.g., one terminal 240 being located or spaced away from a first side of the longitudinal axis and the other terminal 240 being located or spaced away from an opposite of second side thereof, wherein a line between the centers of terminals 240 is parallel to and offset from the axis of the transverse cylinder defining the shape of keying feature 230. The shape of terminals 240 may be circular or rectangular or any other desired regular or irregular shape, and may be recessed as illustrated or may not be recessed.

The keying feature 230 illustrated in FIGS. 3A-3F may be, e.g., defined as the shape of an intersection of a rectangular solid whose axis is transverse to a longitudinal axis of generally cylindrical power source 200 and is offset therefrom in a direction away from its charging port 250. The axis of the transverse rectangular solid may be outside the volume of power source 200. Thus charging port 250 and keying feature 230 are in known predetermined locations of cylindrical source 200, and the shape of keying feature 230 may be, e.g., a part of the surface of the transverse rectangular solid, e.g., two flat surfaces whose intersection (i.e. a line) is transverse to the longitudinal axis of power source 200. In that example, those known predetermined locations include keying feature 230 and charging port 250 being radially opposite each other, e.g., radially 180° apart, and charging port 250 being in a known predetermined axial location by being a known predetermined axial distance from the end of power source 200 at which keying feature 230 and terminals 240 are located.

Further, terminals 240 illustrated in FIGS. 3A-3F are also at respective known predetermined locations, e.g., being spaced apart on opposite ends of power source 200 by a known predetermined distance, e.g., the length of power source 200. Those terminals 240 typically would be centered on each end of power source 200, e.g., on the longitudinal axis thereof, wherein a line between the centers of terminals 240 is parallel to and coaxial with from the longitudinal axis thereof. The shape of terminals 240 may be circular or rectangular or any other desired regular or irregular shape, and may be flush or projecting or recessed.

Power source 200 has a charging port 250 whereat an external charging device may be connected to recharge power source 200. In a preferred embodiment, charging port 250 includes an electrical connector, e.g., a coaxial connector 250 or a USB connector, e.g., a USB connector, mini-USB connector, a micro-USB connector, a USB-C connector, FireWire connector, a Lightning connector, or another commonly used electrical connector.

Charging port 250 is located on power source 200 in a known predetermined spatial relationship relative to keying feature 230 thereof, e.g., recess 230, so that controlling the location of recess 230 in light 100 determines the orientation of power source 200 therein and thus the location of charging port 250 in light 100. For example, the relative radial position of recess 230 and charging port 250 and the axial distance of charging port 250 from the end of power source 200 are predetermined. In a preferred embodiment, charging port 250 is 180° radially around from keying feature 230 and is a known axial distance from the end of power source 200, and light body 120 has a keying feature 126 near an end of its internal cavity 122 that is complementary to keying feature 230 and has an opening 124 which is 180° radially around therefrom and the known axial distance therefrom, so that charging port 250 is constrained by complementary keying features 230, 126 to be aligned with opening 124, whereby an external charging device can be directly connected to charging port 250 of power source 200 through the opening 124.

Rechargeable lithium batteries typically require electrical circuitry to limit the charging and discharging of the lithium cell(s) therein to safe levels, and such circuitry is often provided on an electronic circuit board 252 that is packaged internally to a lithium battery, e.g., power source 200. Typically, it is convenient that electrical connector 254 of charging port 250 be mounted on such circuit board 252 adjacent to an opening in housing 210 so as to be accessible to and radially directly connectable with a compatible connector of an external charging source. Typically, case or housing 210 may include a cylindrical main part which contains the rechargeable electrical, power or energy cell 270, e.g., a rechargeable lithium electrical cell 270 or battery 270, and a cap 210C therefor which may enclose, e.g., circuit board 252 and which may have one or more recessed terminals 240 thereon or one or more recessed openings for one or more terminals 240, e.g., two recessed openings for the example two terminals 240 illustrated in FIGS. 2A-2F.

Where keying feature 230 of power source 200 is, e.g., a concave curved recess 230, then complementary keying feature 126 in cavity 122 is, e.g., a convex curved projection 126 of similar compatible size and shape. Similarly, where keying feature 230 of power source 200 is, e.g., a rectangular recess 230, then complementary keying feature 126 in cavity 122 is, e.g., a rectangular projection 126 of similar compatible size and shape. Alternatively, keying features 230 and 126 may be of any suitable shape and size, and/or keying feature 230 may be a projection and keying feature 126 may be a recess.

Figure 4:
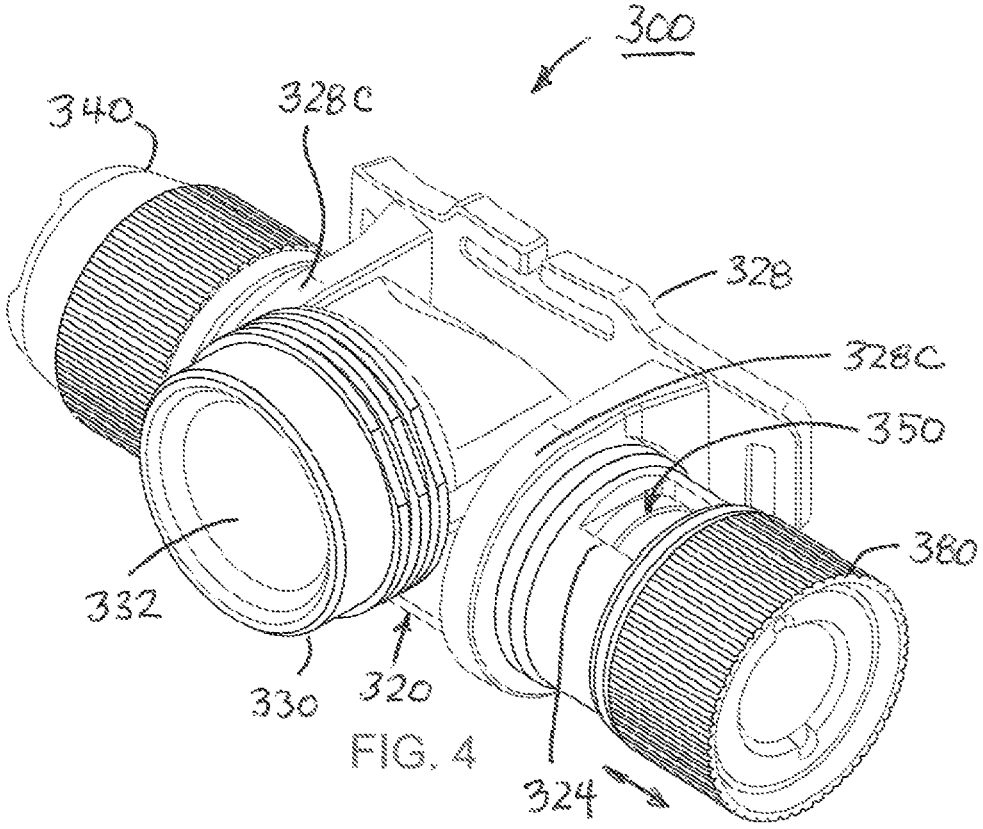
FIG. 4 is a perspective view of an example embodiment of a portable head light having an opening for connecting an external charging device directly to a charging connector inside the example light.
Figure 4A:
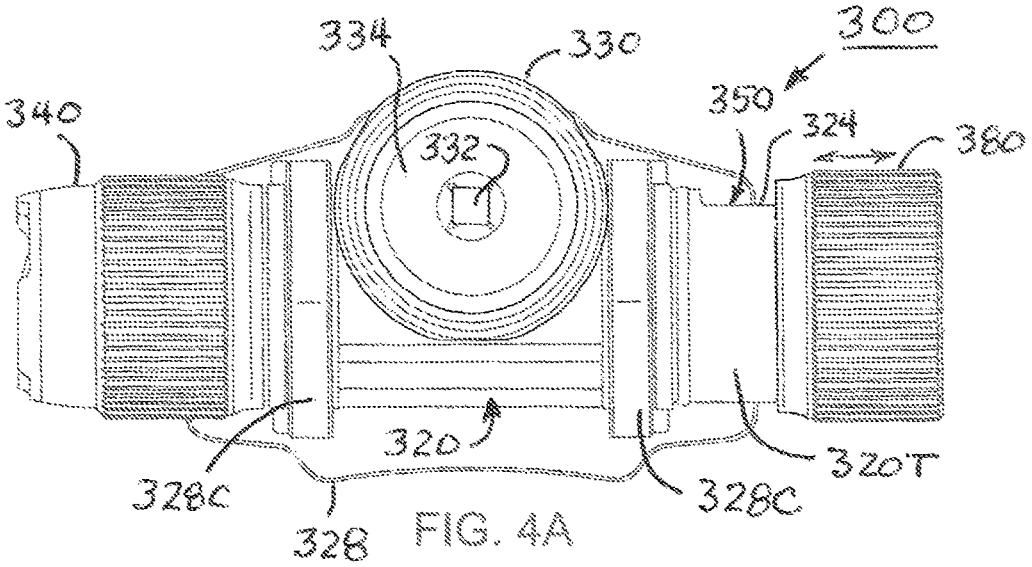
FIGS. 4A, 4B and 4C are side views of the example embodiment of such portable head light.
Figure 4B:
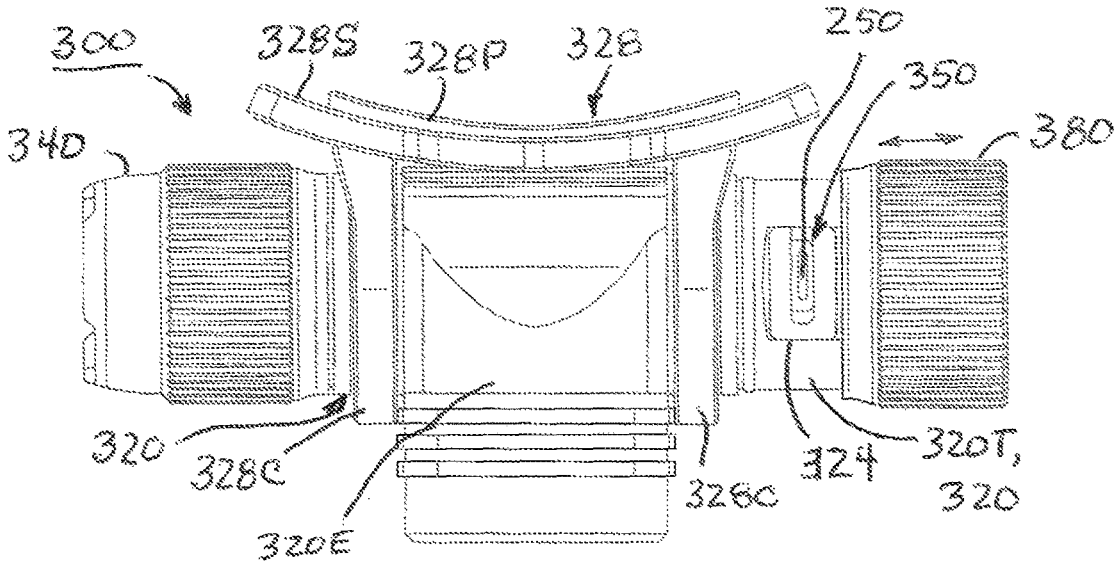
Figure 4C:
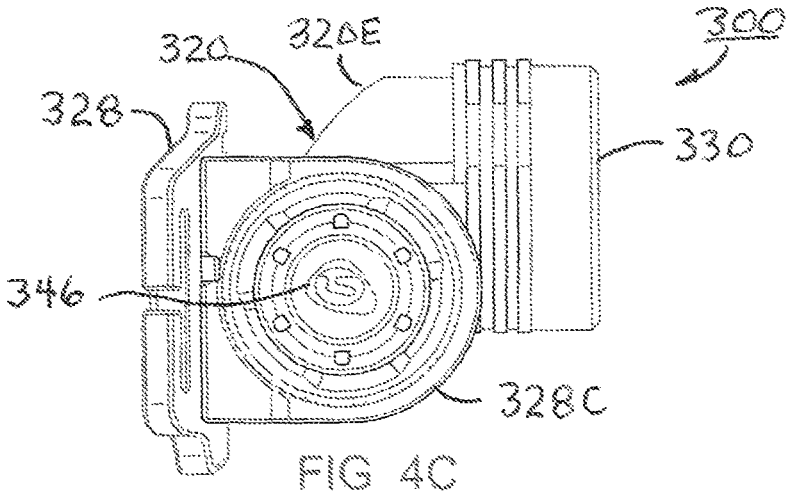
Figure 4D:
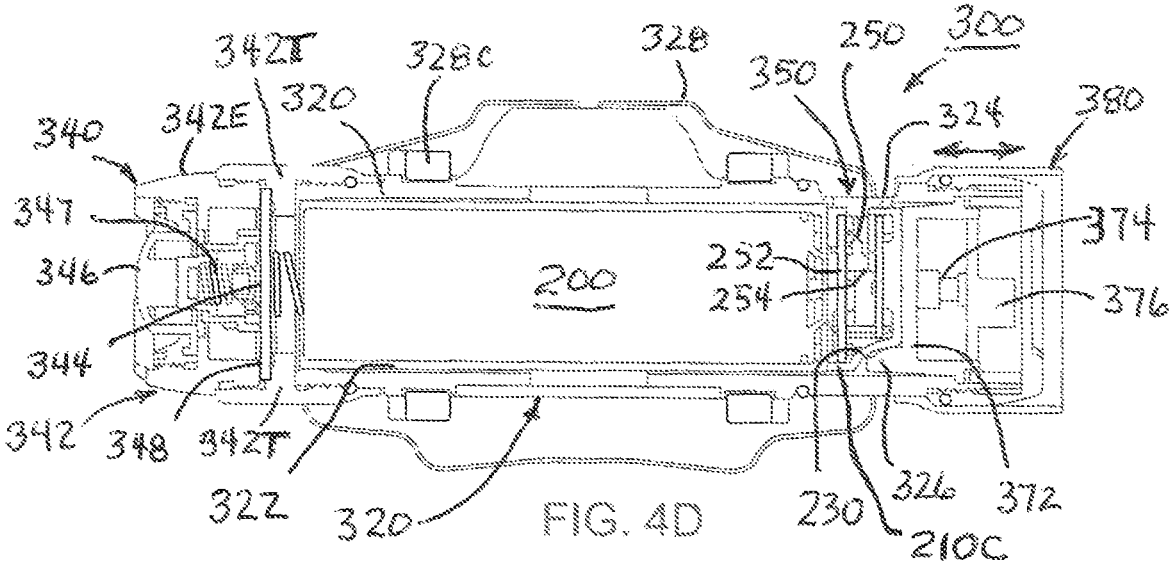
FIGS. 4D and 4E are cross-sectional views thereof.
Figure 4E:
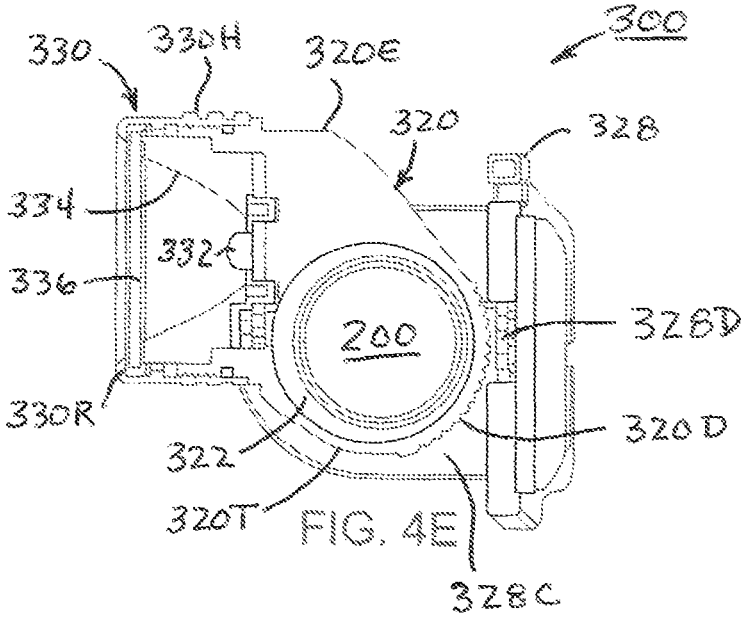

FIG. 4 is a perspective view of an example embodiment of a portable head light 300 having an opening 350, 324 for connecting an external charging device directly to a charging connector 250 inside the example light 300, FIGS. 4A, 4B and 4C are side views of the example embodiment of such portable light 300, and FIGS. 4D and 4E are cross-sectional views thereof. Example portable light 300, e.g., a so-called head light that is configured to be wearable on a user's head or head wear, ed a hat or helmet, is generally T-shaped and has a T-shaped light body 320 including a transverse cylindrical body part 320T having an extension 320E extending transversely therefrom, e.g., typically centrally. A light head 330 includes a light source 332 at a forward end thereof. An end cap 340 attaches at one end of the transverse part 320T of light body 320 and a cover 380 attaches at the opposite end thereof. Light 300 has a charging port 350 whereat an external source of electrical power, e.g., an external charging device, may be connected for recharging the source of electrical power 200 of light 300.

Example light body 320 has a tubular part 320T that has a cavity 322 therein in which a source of electrical power 200 is disposed for providing electrical power to energize the light source 332, e.g., a light emitting diode 332, of light head 330. Light body 320 is configured to receive light head 330 on the end of the body extension 320E and to receive end cap 340 and cover 380 on the opposite ends of transverse part 320T thereof. Light body 320 has an opening 324 relating to charging port 350 through which access to charging port 250 of power source 200 is available.

Typically, a bracket 328 may be provided on light body 320 to which a head band or head strap may be attached for enabling light 300 to be worn by a user, e.g., on the user's head. Bracket 328 typically has a saddle 328S that is curved, and that optionally has a pad or cushion 328P, for the user's comfort. One or more clips 328C, e.g., two curved or circular clips 328C, extend from the saddle of bracket 328 for grasping the cylindrical part 320C or light body 320 to retain bracket 328 thereon. Preferably, curved clips 328C provide a movable grasping of cylindrical part 320C so that bracket 328 may be rotated around light body 320, and an optional detent 320D, e.g., an arc or projections on light body 320, engage a flexible detent 328D of bracket 328 so that bracket 328 tends to remain in a position relative to light body 320 to which a user has moved it.

Example light head 330 includes a head housing 330H that also serves as a lens retainer ring 330R that attaches to light body 320 and that contains the light source. Light source 332 is preferably a light emitting diode (LED) 332 that produces light when energized. Housing 330H also includes an optical element 334 disposed in front of LED 332 for forming the light produced thereby into a beam having desired characteristics. Optical element 334 may be a shaped reflector or may be a solid optical element, e.g., a totally internally reflective (TIR) optical element. A lens 336 covers the front face of light head 330 to reduce entry of dirt, debris and moisture into light head 330 and light 300.

Typically, one or more electronic circuit boards 376 may be disposed in light 300, e.g., rearwardly in head housing 330 and/or at or near one or both ends of the transverse part of light body 320, as may be convenient, for controlling the application of electrical power from the source 200 thereof to light source 332 for energizing light source 332 to produce light in response to an electrical switch. In the illustrated embodiment, circuit board 376 supports the one or more contacts 374 which make contact with the terminals 420 of power source 200.

Example end cap 340 includes a housing 342 in which is disposed an electrical switch 344 that can be actuated to open and close one or more electrical contacts thereof for controlling the operation of portable light 300, e.g., for energizing and de-energizing light source 332 thereof. End cap 340 housing 342 has a threaded end 342T that attaches end cap 340 to light body 320 and electrical switch 344 is disposed within end cap housing 342. A flexible actuator 346, e.g., a boot 346, may be provided to reduce entry of dirt, debris and moisture into end cap 340 and light 300. Pressing and releasing flexible actuator 346 causes the actuation and de-actuation of electrical switch 344.

Specifically, electrical switch 344 is disposed in end housing part 342E thereof to which is attached threaded housing part 342T to retain boot 346 and switch 344 and their associated parts in end cap 340. Threaded housing part 342T threadingly engages threads on light body 320 for removably attaching end cap 340 thereto. Internal cavity 322 is accessed by removing end cap 340 from light body 320 thereby enabling a power source 200 to be placed into cavity 322 and removed from cavity 322, and attaching end cap 340 to light body 320 to retain a power source 200 therein.

Example light body 320 may have plural parts, e.g., a transverse part 320T which may include plural sub-parts and light head extension 320E. In the illustrated example light body 320, light head extension 320E has a cylindrical bore into which two opposing end parts of transverse part 320T are disposed to define light body 320. Optionally, but preferably, clips 328C of bracket 328 are rings 328C through which the two opposing end parts of transverse part 320T are respectively disposed so that bracket 328 is rotatably retained on light body 320.

Example end cap or cover 380 threads onto an end of transverse housing part 320T when light 300 is assembled and is not removed by a user. Cover 380 retains an internal interface member 372 in housing part 320T which includes engaging feature 326, or keying feature 326. A circuit board 376 is included therein which supports one or more electrical contacts 374 that make electrical connections to terminals 240 of an power source 200 disposed in internal cavity 322. Internal member 372 is in turn keyed or otherwise oriented with respect to the interior of transverse part 320T so that engaging feature 326 is disposed in the known predetermined relationship with respect to opening 324 of charging port 350 of light 300, e.g., 180° around therefrom.

Optionally, but preferably, a cover 360 may be provided on light body 320 for covering and uncovering charging port 350. In the illustrated embodiment, cover 380 on one end of light body 320 includes a housing part 382H that is attached to light body 320 and a slidable part 382S that slides toward and away from light body 320 on housing part 382H, as indicated by a double-ended arrow, thereby serving as a cover 360 for charging port 350 of light 300. Moving cover 360 (housing part 382S) away from light body 320 exposes charging port 350 (including opening 324 through which access to charging port 250 of power source 200 is available) and moving cover 360 (housing part 382S) toward light body 320 covers charging port 350.

Example source of electrical power 200 includes an externally accessible charging port 250 to which an external source of charging power may be connected for charging and recharging power source 200 when it is in a device, e.g., portable light 300, or not in a device. Typically, one example power source 200 includes a rechargeable battery 200, e.g., a rechargeable lithium battery 200, that has a symmetrical shape, e.g., a cylindrical shape, as do other common batteries. Because a symmetrical source of electrical power can be placed into a compatible cavity in different radial orientations, if a charging port 350 is provided thereon, then the charging port 350 thereof can be different radial positions relative to the cavity 322, i.e. the housing into which it is placed, and so would not necessarily align with the opening 324 in the light body 320.

Importantly, portable light 300 and power source 200 differ from other lights and power sources in that light 300 and power source 200 each have an asymmetrical feature, e.g., a keying feature, that is complementary to that of the other so that power source 200 may only be fully placed into cavity 324 of light 300 when their respective keying features are aligned and engaged. The respective keying features are complementary, e.g., one may be a recess while the other is a projection of similar size and shape, such that the projection keying feature fits into the recess keying feature. This can occur only when the power source 200 is in a predetermined radial orientation whereat the projection keying feature is aligned with the recess keying feature.

Keying feature 326 of light 300 is provided for cavity 322 of housing 320 thereof in a predetermined known position relative to opening 324 through housing 320, e.g., diametrically opposite opening 324, which also may be described as being 180 degrees radially around therefrom. Keying feature 230 of power source 200 is provided on housing 210 thereof in a predetermined known position relative to charging port 250 thereof, e.g., diametrically opposite charging port 250 which also may be described as being 180 degrees radially around therefrom.

Because each of the respective keying features 326, 230 are in complementary predetermined known positions relative to opening 324 and charging port 250, respectively, when keying features 326, 230 are engaged, power source 200 is in a known predetermined position in cavity 322 and light body 320 whereat charging port 250 of power source 200 is adjacent to and is aligned with opening 324 of light body 320, thereby to define an external charging port 350 of light 300. As a result, charging port 350 provides direct access to power source charging port 250 through opening 324 in light body 320 of light 300, whereby an external power source may be directly connected to power source 200, i.e. to charging port 250 thereof, through opening 324.

Even when power source 200 may include a symmetrical internal energy cell 270, e.g., a battery cell 270 or other cylindrical cell 270, case 210 or housing 210 of power source 200 has one or more asymmetrical external keying features 230 by which power source 200 may only be disposed in light body 320 in the one orientation in which charging port 250 thereof aligns with opening 324 to define the external charging port 350 of light 300.

Figure 5:
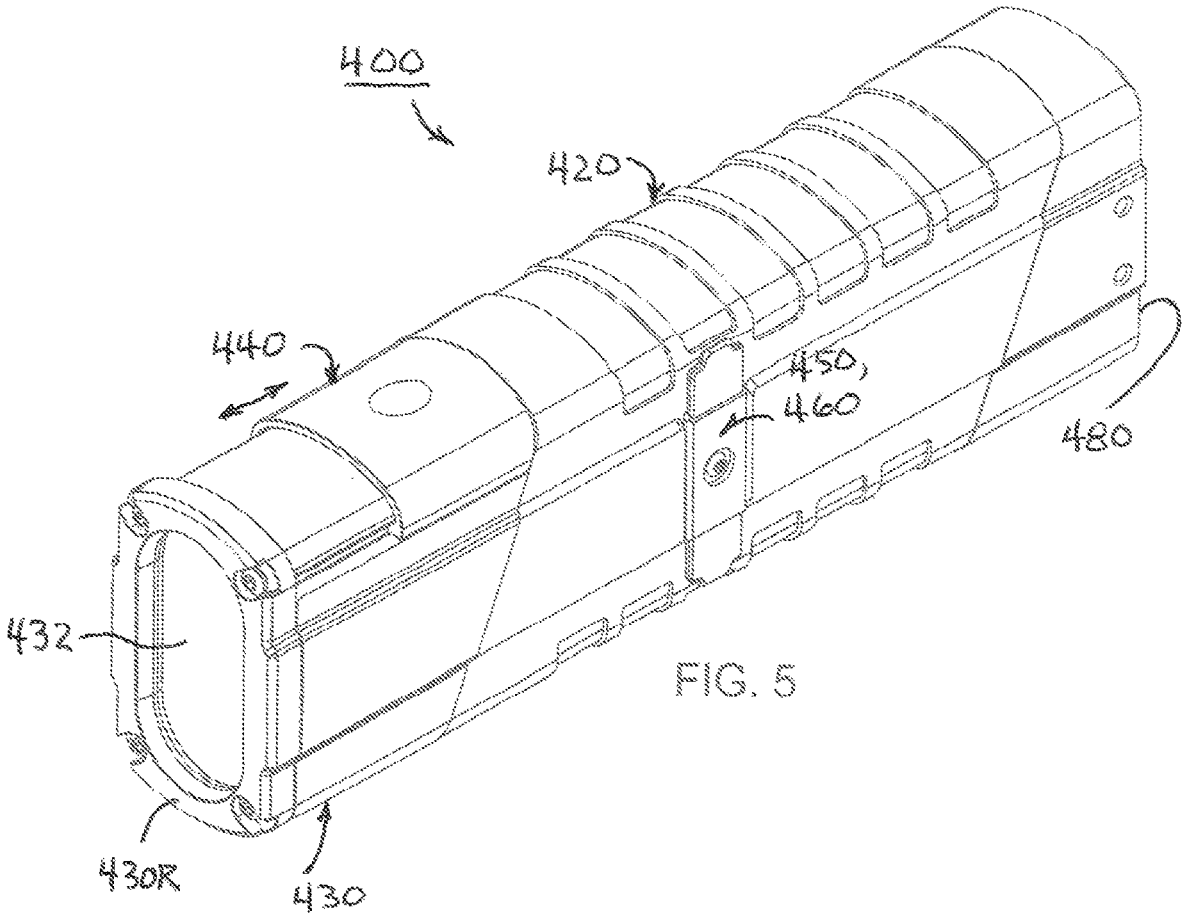
FIG. 5 is a perspective view of an example embodiment of another hand holdable portable light having one or more openings for connecting an external charging device directly to a charging connector of one or more power sources inside the example light.
Figure 5A:
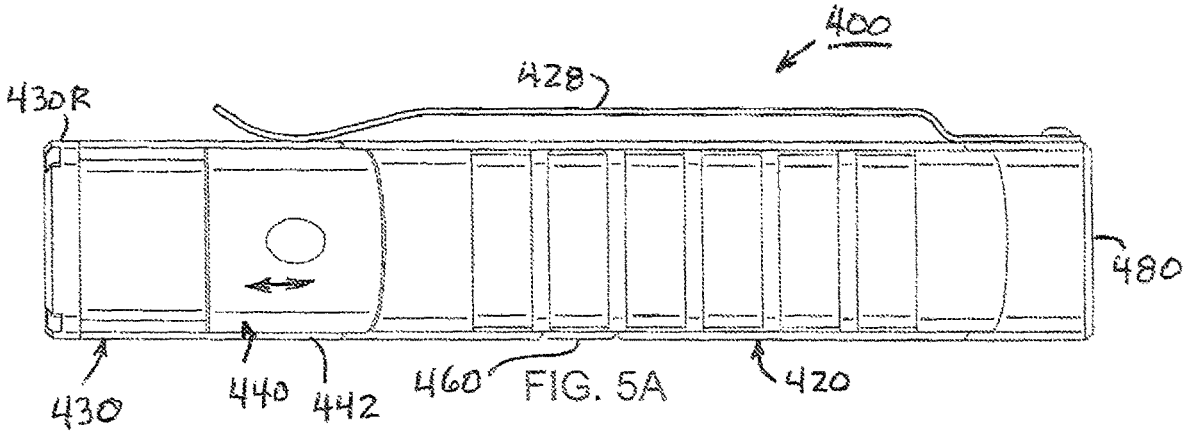
FIGS. 5A, 5B, 5C and 5D are side views thereof
Figure 5B:
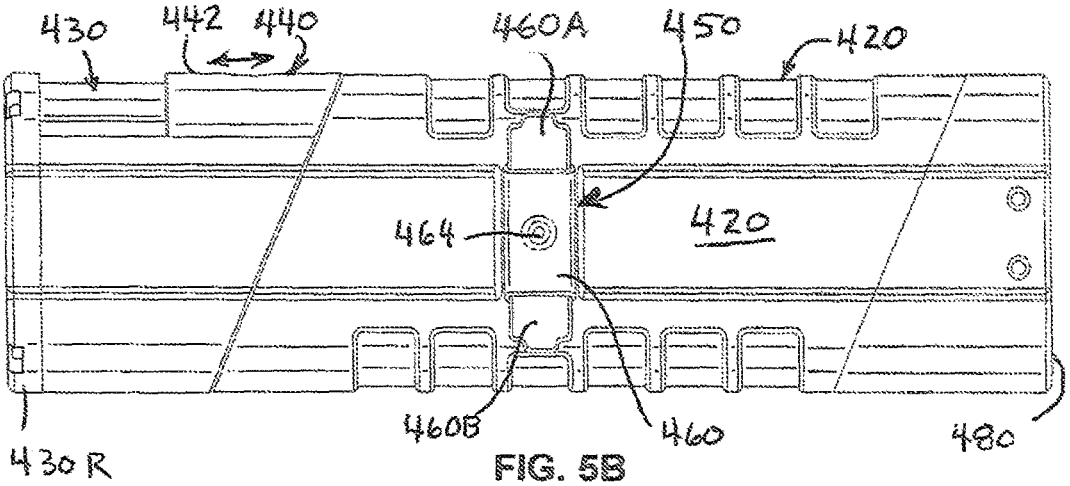
Figure 5C:
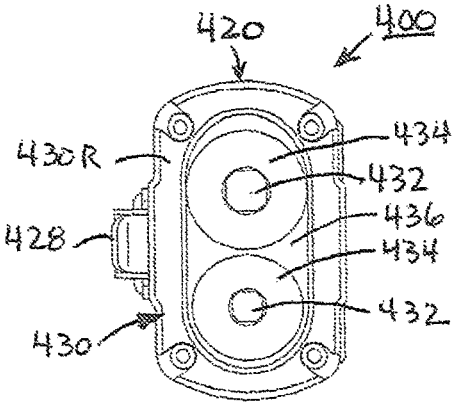
Figure 5D:
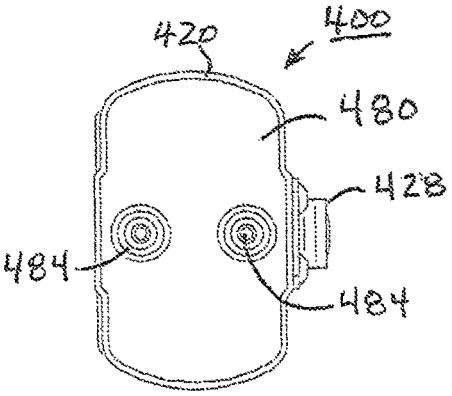
Figure 5E:
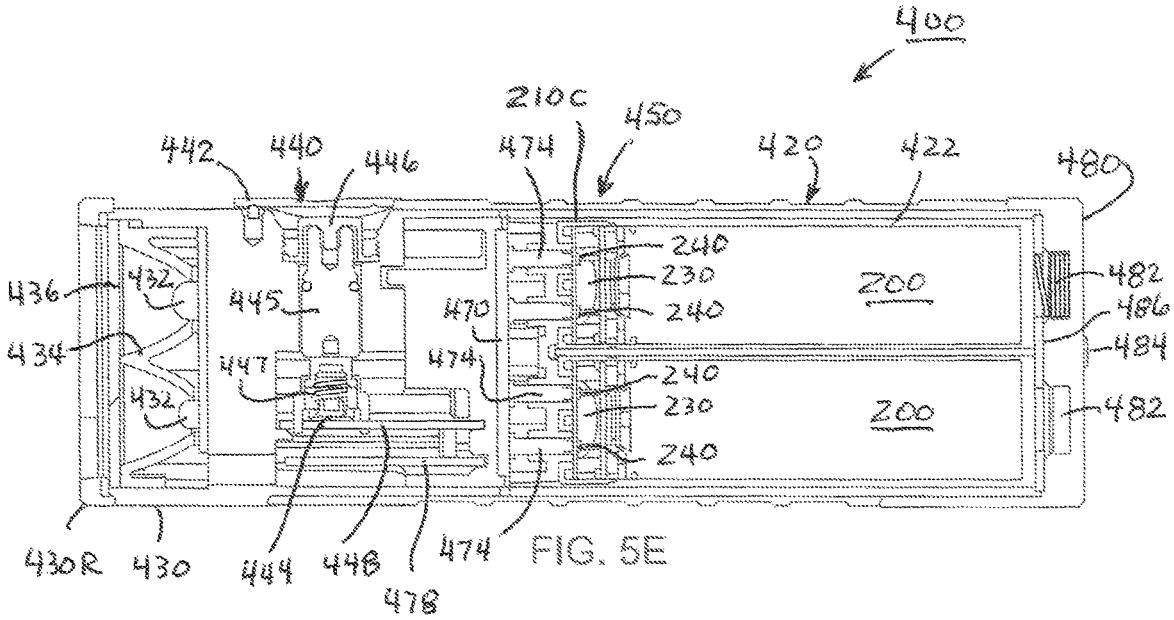
FIGS. 5E, 5F, 5G and 5H are cross-sectional views thereof.
Figure 5F:
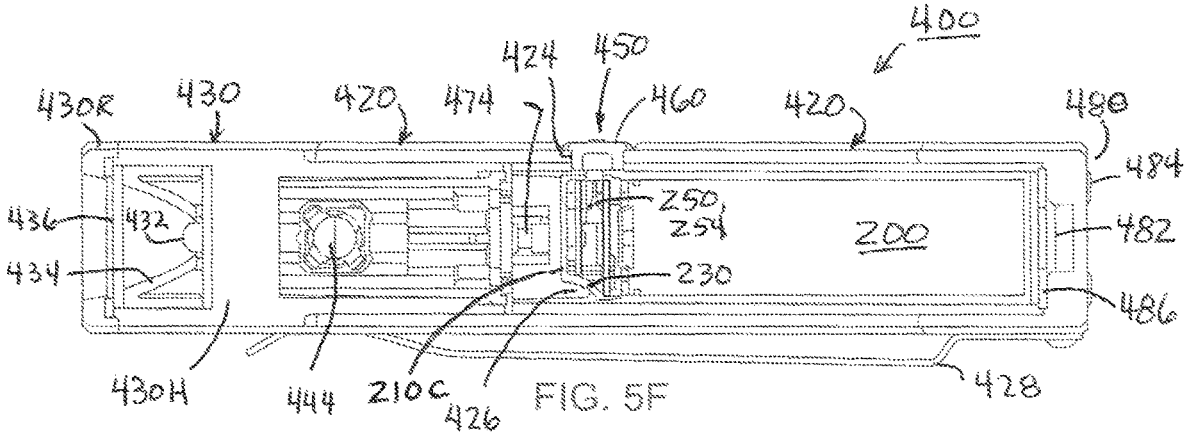
Figure 5G:
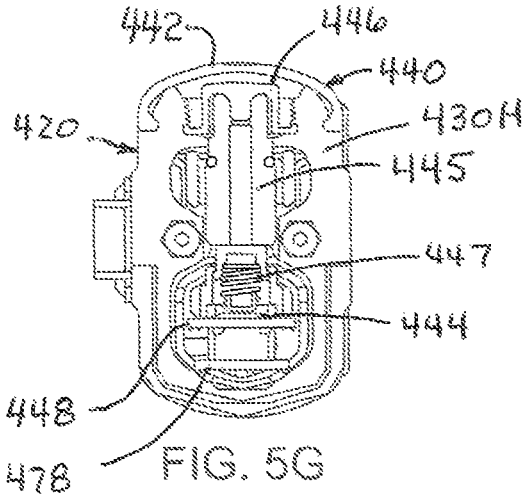
Figure 5H:
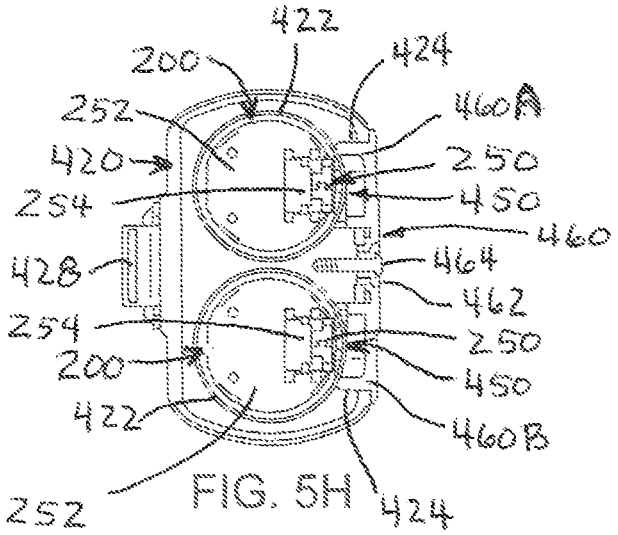

FIG. 5 is a perspective view of an example embodiment of another hand holdable portable light 400 having one or more openings 424 for connecting an external charging device directly to a charging connector 250 of one or more power sources 200 inside the example light, FIGS. 5A, 5B, 5C and 5D are side views thereof and FIGS. 5E, 5F, 5G and 5H are cross-sectional views thereof. Example hand held portable light 400, e.g., a light configured to be holdable in a user's hand, is generally rectangular in shape and may have some rounded sides and corners. Light 400 has a light body 420 with a light head 430 including a light source 432 at a forward end thereof and a tail cap 480 or cover 480 at a rearward end thereof. Lights with such configuration may be referred to as flashlights, although that term is often more broadly used. Light 400 has one or more charging ports 450 on a flat side thereof whereat an external source of electrical power, e.g., an external charging device, may be connected for recharging the on or more sources of electrical power 200 of light 400.

Example light body 420 is generally rectangular in shape and has a cavity 422 therein in which one or more sources of electrical power 200 are disposed for providing electrical power to energize the light source 432, e.g., one or more light emitting diodes 432, of light head 430. Light body 420 is configured to have a light head 430 on one end thereof and to receive tail cap or cover 480 on the other end thereof. Light body 420 has one or more openings 424 relating to and aligned with the charging ports 450 of the one or more power sources 200 therein. Optionally, but preferably, a cover 460 is provided on light body 420 for covering and uncovering charging port 450. Optionally, a clip 428 may be provided on light body 420.

Example light head 430 includes a head housing 430H that attaches to light body 420 and that contains the light source 432. Light source 432 is preferably one or more light emitting diodes (LED) 436 that produce light when energized. Front housing 430H also includes an optical element 434 disposed in front of the one or more LEDs 432 for forming the light produced thereby into a beam having desired characteristics. Optical element 434 may be a shaped reflector or may be a solid optical element, e.g., a totally internally reflective (TIR) optical element, that is configured for the number and configuration of light sources 432 provided. A lens 436 covers the front face of light head 430 to reduce entry of dirt, debris and moisture into light head 430 and light 400, and is retained thereon by lens retainer 430R.

Example light head 430 may have two parts, e.g., a main housing 430H and a lens retainer 430R that retains optical element 434 and lens 436 therein. Typically, one or more electronic circuit boards 470 are disposed in light 400, e.g., rearwardly in head housing 430 and/or in light body 420, as may be convenient, for controlling the application of electrical power from the electrical power source 200 thereof to light source 432 for energizing light source 432 to produce light in response to an electrical switch 440.

Example light head 430 includes a housing 430H in which is disposed an electrical switch 444 that can be actuated to open and close one or more electrical contacts thereof for controlling the operation of portable light 400, e.g., for energizing and de-energizing light source 432 thereof. A flexible actuator 446, e.g., a boot 446, may be provided to reduce entry of dirt, debris and moisture into light 400. Pressing and releasing flexible actuator 446 causes the actuation and de-actuation of electrical switch 440. Optionally a cover 442 may be provided to prevent actuation of switch 440. Example cover 442 is slidable forwardly to uncover switch 440 so that it can be actuated and is slidable rearwardly to cover switch 440 so that it cannot be actuated.

The example housing 430 may have plural features, e.g., a transverse bore in which are disposed actuation elements of switch 440 and a cavity in which are disposed electrical switch 444 and one or more circuit boards 448, 478. Flexible actuator or boot 446 is disposed at an end of the bore at the surface of light head 430 whereat it can be pressed by a user and a plunger 445 movable in the bore is adjacent the inner side of flexible boot 446. Movement of plunger 445 is coupled to electrical switch 444 by actuator parts 447, e.g., a spring and cups 447. Electrical switch 444 is disposed on circuit board 448 within head housing parts 430H.

Each example source of electrical power 200 includes an externally accessible charging port 250 to which an external source of charging power may be connected for charging and recharging power source 200 when it is in a device, e.g., portable light 400, and not in a device, as described. In the example light 400, two example power sources 200 including rechargeable batteries 200, e.g., a rechargeable lithium battery 200, are provided in a side by side arrangement within cavity 422 of light body 420. that has a symmetrical shape, e.g., a cylindrical shape, as do other common batteries. Because a symmetrical source of electrical power can be placed into a compatible cavity 422 in different radial orientations, if a charging port 450 is provided thereon, then the charging port thereof can be different radial positions relative to the cavity 422, i.e. the housing into which it is placed, and so would not necessarily align with the opening 424 in the light body 420.

Importantly, portable light 400 and power source 200 differ from other lights and power sources in that light 400 and each of the one or more power source 200 each have an asymmetrical feature, e.g., a keying feature, that is complementary to that of the other so that power source 200 may only be fully placed into cavity 424 of light 400 when their respective keying features are aligned and engaged. The respective keying features are complementary, e.g., one may be a recess while the other is a projection of similar size and shape, such that the projection keying feature fits into the recess keying feature. This can occur only when the power source 200 is in a predetermined radial orientation whereat the projection keying feature is aligned with the recess keying feature.

Respective keying features 426 in cavity 422 of light 400 are provided for each electrical power source 200 thereof that can be disposed in cavity 422 of housing 420 thereof, each in a predetermined known position relative to a respective opening 424 through housing 420, e.g., diametrically opposite opening 424, which also may be described as being 180 degrees radially around therefrom. Keying feature 230 of each power source 200 is provided on housing 210 thereof in a predetermined known position relative to charging port 250 thereof, e.g., diametrically opposite charging port 250 which also may be described as being 180 degrees radially around therefrom.

Because each of the respective keying features 426, 230 are in complementary predetermined known positions relative to a respective opening 424 and charging port 250, respectively, when keying features 426, 230 are engaged, each power source 200 is in a known predetermined position in cavity 422 and light body 420 whereat charging port 250 of power source 200 is adjacent to and is aligned with its respective opening 424 of light body 420, thereby to define an external charging port 450 of light 400. As a result, each charging port 450 provides direct access to a respective power source charging port 250 through a respective opening 424 in light body 420 of light 400, whereby an external power source may be directly connected to power source 200, i.e. to charging port 250 thereof, through opening 424.

Even when power source 200 may include a symmetrical internal energy cell 270, e.g., a battery cell 270 or other cylindrical cell 270, case 210 or housing 210 of power source 200 has one or more asymmetrical external keying features 230 by which power source 200 may only be disposed in light body 420 in the one orientation in which charging port 250 thereof aligns with opening 424 to define the externally accessible charging port 450 of light 400.

Cover 480, e.g., a battery cover 480, at the rear end of light body 420 is removable so as to permit the one or more power sources 200 to be placed into and removed from cavity 422 of light body 420. Respective springs 482 on an inner side of cover 480 bias power sources 200 to move forwardly and into contact with contacts 474, e.g., battery contacts 474. Respective battery contacts 474 are provided for electrically connecting respective terminals 240 of power sources 200 with circuit board 470 which supports contacts 474. Cover 480 maybe retained on light body 420 by one or more fasteners 484 and have a seal or gasket 486.

In the illustrated example light 400, port cover 460 for charging port 450 comprises two covers 460, e.g., covers 460A and 460B, that are flexibly connected to light body 420 via a cover part or structure 462. Where port cover 460 has two covers 460A, 460B, the two covers 460A, 460B are flexibly connected to cover structure 422, typically at opposing sides thereof. Port cover 460 is retained on light body 420 by a fastener 464 that passes through cover part 462 thereof into light body 420. Preferably, port cover 460 is a single part of a flexible material, e.g., a rubber or silicone or other elastomer, having a shape configured to be thinner and more flexible where covers 460A, 460B join center part 462 so that covers 460A, 460B can be rotated outwardly and away from light body 420 to respectively expose charging ports 450 and in the opposite direction towards light body 420 to respectively cover charging ports 450. Preferably, each cover 460A, 460B has a flexible rim which is of complementary shape to opening 424, whereby it is removably retained in a respective opening 424 and preferably provides a seal thereof that reduces the entry of moisture, dirt and debris into light 400 via port 450.

In a typical embodiment, various housings and parts thereof, e.g., parts 210, 120, 220, 320, 328, 420, 130, 330, 430, 140, 340, 440, 442, 160, 260, 360, 460, 480 and the like may be a reinforced nylon, engineered nylon, engineered nylon, nylon 6, nylon 66, polyamide, polyamide 66, reinforced polyamide, reinforced polyamide 66, acrylonitrile butadiene styrene (ABS), polycarbonate, polyethylene, polypropylene, polycarbonate, polyester-polycarbonate blend, ABS polycarbonate blend, or other suitable plastic material, or of a cast, molded, forged, or machined metal. Where a part provides heat sinking, e.g., in light head 130, 330, 430, such may include a relatively highly thermally conductive material such as aluminum, brass, copper, magnesium, cast metal, and/or a plastic filled with thermally conductive particles, e.g., a thermally conductive reinforced nylon, engineered nylon, acrylonitrile butadiene styrene (ABS), polycarbonate, polyethylene, polypropylene, or other suitable thermally conductive plastic material, e.g., a plastic that includes (is filled with) thermally conductive particles, flakes, strands or other thermally conductive material, as well as other materials having suitable strength and thermal conductivity. Metal parts, such as clips 128, 428, fasteners 464, and springs may be of any suitable metal, e.g., aluminum, steel, spring steel, metal wires, brass, bronze, magnesium, beryllium copper, cast metal, and the like. Resilient and/or flexible parts, such as flexible boots 146, 346, 446, covers 460 and seals, may be of any suitable flexible and/or resilient material, e.g., rubber, neoprene rubber, elastomers, thermoplastic elastomers (TPEs), silicones, urethanes, MONOPRENE® rubber, nylon-bondable SANTOPRENE® rubber, HERCUPRENE rubber, NYLABOND® TPE over-molding material, AuroraFlex™ TPE over-molding material, and other suitable materials.

A rechargeable portable light 100, 300, 400 may comprise: a light body 120, 320, 420 having at least one exterior wall for defining at least a part of an internal cavity configured to receive a rechargeable power source 200, wherein the internal cavity has a keying feature and has an opening through the exterior wall that is in a predetermined location relative to the keying feature of the internal cavity; a light source 132, 332, 432 supported by the light body 120, 320, 420 for producing light when energized; a rechargeable power source 200 having a charging connector in a side thereof and having a keying feature, wherein the keying feature thereof is in a predetermined location relative to the charging connector such that when the rechargeable power source 200 is placed into the internal cavity of the light body 120, 320, 420 with the keying feature of the rechargeable power source 200 engaging the keying feature of the internal cavity the charging connector of the rechargeable power source 200 is aligned with the opening through the exterior wall of the light body 120, 320, 420; and an electrical switch for selectively coupling the rechargeable power source 200 to the light source 132, 332, 432 for energizing the light source 132, 332, 432 to produce light; whereby a connector of an external source of charging power can be connected through the opening through the light body 120, 320, 420 directly to the charging connector of the rechargeable power source 200 for recharging the rechargeable power source 200. The light body 120, 320, 420 may include a cover for the internal cavity that is openable for placing the rechargeable power source 200 into the internal cavity of the light body 120, 320, 420 and for removing the rechargeable power source 200 from the internal cavity thereof. The keying feature of the internal cavity may be at an end of the internal cavity that is distal from the cover for the internal cavity. The keying feature of the internal cavity may be one of a projection and a recess, and the keying feature of the rechargeable power source 200 may be the other of a recess and a projection. The keying feature of the internal cavity may be proximate one of more electrical contacts in the internal cavity that make electrical connection to corresponding one or more electrical terminals of the rechargeable power source 200 when the rechargeable power source 200 is in the internal cavity with its keying feature engaging the keying feature of the internal cavity. The keying feature of the internal cavity may be: a projection defining a convex surface proximate an end of the internal cavity; or a projection defining two planar surfaces having an intersection that is transverse to the internal cavity; or a recess defining a concave surface proximate an end of the internal cavity; or a recess defining two planar surfaces having an intersection that is transverse to the internal cavity and is proximate an end of the internal cavity. The keying feature of the rechargeable power source 200 may be: a projection defining a convex surface proximate an end of the rechargeable power source; or a projection defining two planar surfaces having an intersection that is transverse to the rechargeable power source; or a recess defining a concave surface proximate an end of the rechargeable power source; or a recess defining two planar surfaces having an intersection that is transverse to and is proximate an end of the rechargeable power source. The one or more electrical terminals of the rechargeable power source 200 may include: a central terminal and a concentric annular terminal on an end of the rechargeable power source 200; or two side by side terminals on the end of the rechargeable power source 200. The rechargeable portable light may further comprise a cover movable relative to the exterior wall of the light body 120, 320, 420 for covering and uncovering the opening through the exterior wall of the light body 120, 320, 420. The rechargeable portable light may further comprise a cover movable toward and away from the exterior wall of the light body 120, 320, 420 for covering and uncovering the opening through the exterior wall of the light body 120, 320, 420. The rechargeable portable light may further comprise an annular collar slidable along the exterior wall of the light body 120, 320, 420 for covering and uncovering the opening through the exterior wall of the light body 120, 320, 420. The rechargeable power source 200 may include a rechargeable battery; or the rechargeable power source 200 may include a rechargeable lithium battery. The charging connector of the rechargeable power source 200 may include: a coaxial connector, a USB connector, a mini-USB connector, a micro-USB connector, a USB-C connector, a FireWire connector, a Lightning connector, or a combination thereof. The keying feature 230 of the rechargeable power source 200 may be: recess defining a concave surface proximate an end of the rechargeable power source 200; or a recess defining a concave part of a cylindrical surface proximate an end of the rechargeable power source 200; or a recess defining two planar surfaces having an intersection that is transverse to a longer dimension of the rechargeable power source 200 and is proximate an end of the rechargeable power source 200. The rechargeable power source 200 may have a cylindrical case, wherein at least one of the one or more electrical terminals is on a circular terminal end of the power source case, wherein the charging connector is at a predetermined radial location and is a predetermined distance from the terminal end of the power source case. The keying feature of the rechargeable power source 200 may be at a location that is about 180° radially from the charging connector and is proximate the circular terminal end. The power source case may include a cylindrical main part which contains the rechargeable electrical cell and a cap therefor, wherein: the cap encloses an electrical circuit board; or the cap has one or more recessed openings for the one or more electrical terminals; or; the cap encloses an electrical circuit board and has one or more recessed openings for the one or more electrical terminals. The rechargeable power source 200 may be cylindrical having one or more terminals at a terminal end thereof, wherein the keying feature of the rechargeable power source 200 is: a recess defining a concave surface proximate the terminal end of the rechargeable power source 200; or a recess defining a concave part of a cylindrical surface proximate the terminal end of the rechargeable power source; or a recess defining two planar surfaces having an intersection that is transverse to a longer dimension of the rechargeable power source 200 and is proximate the terminal end of the rechargeable power source 200.

A rechargeable portable light 100, 300, 400 may comprise: a light body 120, 320, 420 having at least one exterior wall for defining at least a part of an internal cavity configured to receive a rechargeable battery 200, wherein the internal cavity has a keying feature and has an opening through the exterior wall that is in a predetermined location relative to the keying feature of the internal cavity; a light source 132, 332, 432 supported by the light body 120, 320, 420 for producing light when energized; a rechargeable battery 200 having a charging connector in a side thereof and having a keying feature, wherein the keying feature thereof is in a predetermined location relative to the charging connector such that when the rechargeable battery 200 is placed into the internal cavity of the light body 120, 320, 420 with the keying feature of the rechargeable battery 200 engaging the keying feature of the internal cavity the charging connector of the rechargeable battery 200 is aligned with the opening through the exterior wall of the light body 120, 320, 420; and an electrical switch for selectively coupling the rechargeable battery 200 to the light source 132, 332, 432 for energizing the light source 132, 332, 432 to produce light; whereby a connector of an external source of charging power can be connected through the opening through the light body 120, 320, 420 directly to the charging connector of the rechargeable battery 200 for recharging the rechargeable battery 200. The light body 120, 320, 420 may include a cover for the internal cavity that is openable for placing the rechargeable battery 200 into the internal cavity of the light body 120, 320, 420 and for removing the rechargeable battery 200 from the internal cavity thereof. The keying feature of the internal cavity may be at an end of the internal cavity that is distal from the cover for the internal cavity. The keying feature of the internal cavity may be one of a projection and a recess, and the keying feature of the rechargeable battery 200 may be the other of a recess and a projection. The keying feature of the internal cavity may be proximate one of more electrical contacts in the internal cavity that make electrical connection to corresponding one or more electrical terminals of the rechargeable battery 200 when the rechargeable battery 200 is in the internal cavity with its keying feature engaging the keying feature of the internal cavity. The keying feature of the internal cavity may be: a projection defining a convex surface proximate an end of the internal cavity; or a projection defining two planar surfaces having an intersection that is transverse to the internal cavity; or a recess defining a concave surface proximate an end of the internal cavity; or a recess defining two planar surfaces having an intersection that is transverse to the internal cavity and is proximate an end of the internal cavity. The keying feature of the rechargeable battery may be: a projection defining a convex surface proximate an end of the rechargeable battery; or a projection defining two planar surfaces having an intersection that is transverse to the rechargeable battery; or a recess defining a concave surface proximate an end of the rechargeable battery; or a recess defining two planar surfaces having an intersection that is transverse to and is proximate an end of the rechargeable battery. The one or more electrical terminals of the rechargeable battery 200 may include: a central terminal and a concentric annular terminal on an end of the rechargeable battery 200; or two side by side terminals on the end of the rechargeable battery 200. The rechargeable portable light may further comprise a cover movable relative to the exterior wall of the light body 120, 320, 420 for covering and uncovering the opening through the exterior wall of the light body 120, 320, 420. The rechargeable portable light may further comprise an annular collar slidable along the exterior wall of the light body 120, 320, 420 for covering and uncovering the opening through the exterior wall of the light body 120, 320, 420. The charging connector of the rechargeable battery 200 may include: a coaxial connector, a USB connector, a mini-USB connector, a micro-USB connector, a USB-C connector, a FireWire connector, a Lightning connector, or a combination thereof. The keying feature of the rechargeable battery 200 may be: a recess defining a concave surface proximate an end of the rechargeable battery 200; or a recess defining a concave part of a cylindrical surface proximate an end of the rechargeable battery; or a recess defining two planar surfaces having an intersection that is transverse to a longer dimension of the rechargeable battery 200 and is proximate an end of the rechargeable battery 200. The rechargeable battery may have a cylindrical case, wherein at least one of the one or more electrical terminals is on a circular terminal end of the battery case, wherein the charging connector is at a predetermined radial location and is a predetermined distance from the terminal end of the battery case. The keying feature of the rechargeable battery may be at a location that is about 180° radially from the charging connector and is proximate the circular terminal end. The battery case may include a cylindrical main part which contains the rechargeable electrical cell and a cap therefor, wherein: the cap encloses an electrical circuit board; or the cap has one or more recessed openings for the one or more electrical terminals; or the cap encloses an electrical circuit board and has one or more recessed openings for the one or more electrical terminals. The rechargeable battery 200 may be cylindrical having one or more terminals at a terminal end thereof, wherein the keying feature of the rechargeable battery 200 is: a recess defining a concave surface proximate the terminal end of the rechargeable battery 200; or a recess defining a concave part of a cylindrical surface proximate the terminal end of the rechargeable battery; or a recess defining two planar surfaces having an intersection that is transverse to a longer dimension of the rechargeable battery 200 and is proximate the terminal end of the rechargeable battery 200.

A rechargeable power source 200 for a portable light 100 may comprise: a power source case 210 including a rechargeable electrical cell 270 therein; one or more electrical terminals 240 on an end of the power source case 210 and/or on opposing ends of the power source case 210, wherein the one or more electrical terminals 240 are coupled to the rechargeable electrical cell; a charging connector 250 in an opening in a side of the power source case 210 and coupled to the rechargeable electrical cell 270 for charging the electrical cell; the power source case 210 having a keying feature 230, wherein the keying feature thereof is in a known predetermined location relative to the charging connector 250 such that when the rechargeable power source is placed into a portable light with the keying feature of the rechargeable power source engaging a complementary keying feature of the portable light, the charging connector of the rechargeable power source will be aligned with an opening through an exterior wall of the portable light. The rechargeable power source 200 wherein the power source case 210 is cylindrical, wherein at least one of the one or more electrical terminals 240 is on a circular terminal end of the power source case, wherein the charging connector is at a predetermined radial location and is a predetermined distance from the terminal end of the power source case. The keying feature 230 thereof may be at a location that is about 180° radially from the charging connector and is proximate the circular terminal end. The keying feature thereof may be one of a projection and a recess. The keying feature thereof may be proximate the one or more electrical terminals 240 that make electrical connection to corresponding one or more electrical terminals of the portable light when the rechargeable power source 200 is in the portable light with its keying feature 230 engaging the keying feature of the portable light. The one or more electrical terminals 240 thereof may include: two terminals 240, each one on an opposite end of the rechargeable power source; or a central terminal 240 and a concentric annular terminal 240 on one end of the rechargeable power source; or two side by side terminals 240 on one end of the rechargeable power source. The rechargeable power source 200 may include: a rechargeable battery or a rechargeable lithium battery. The charging connector 250 thereof may include: a coaxial connector, a USB connector, a mini-USB connector, a micro-USB connector, a USB-C connector, a FireWire connector, a Lightning connector, or a combination thereof. The keying feature 230 thereof may be: a recess defining a concave surface proximate an end of the rechargeable power source; or a recess defining a concave part of a cylindrical surface proximate an end of the rechargeable power source; or a recess defining two planar surfaces having an intersection that is transverse to a longer dimension of the rechargeable power source and is proximate an end of the rechargeable power source. The rechargeable power source 200 may be cylindrical having one or more terminals 240 at a terminal end thereof, and wherein the keying feature thereof is: a recess defining a concave surface proximate the terminal end of the rechargeable power source; or a recess defining a concave part of a cylindrical surface proximate the terminal end of the rechargeable power source; or a recess defining two planar surfaces having an intersection that is transverse to a longer dimension of the rechargeable power source and is proximate the terminal end of the rechargeable power source. The power source case 210 may include a cylindrical main part which contains the rechargeable electrical cell 270 and a cap therefor, wherein: the cap encloses an electrical circuit board; or the cap has one or more recessed openings for the one or more electrical terminals; or; the cap encloses an electrical circuit board and has one or more recessed openings for the one or more electrical terminals. The rechargeable power source may be in combination with a portable light which may comprise: a light body configured to receive the rechargeable power source and having a keying feature that is complementary to the keying feature of the rechargeable power source, the light body having an opening through an exterior wall thereof that is in the same known predetermined location relative to the keying feature of the light body as is the charging connector of the rechargeable power source relative to the keying feature thereof; whereby the charging connector of the rechargeable power source is aligned with an opening through the exterior wall of the light body; a light source for producing light when energized; and an electrical switch for selectively energizing the light source to produce light.

A rechargeable power source 200 for a portable light 100, 300, 400 may comprise: a power source case 210 including an electrical cell 270 therein; one or more electrical terminals 240 on an end of the power source case 210 and/or on opposing ends of the power source case, wherein the one or more electrical terminals 240 are coupled to the electrical cell 270; a charging connector 250, 254 in an opening in a side of the power source case 210 and coupled to the electrical cell 270 for charging the electrical cell; the power source case 210 having a keying feature 230, wherein the keying feature 230 thereof is in a known predetermined location relative to the charging connector 250, 254 such that when the rechargeable power source is placed into an internal cavity of a portable light with the keying feature of the rechargeable power source engaging a complementary keying feature of the internal cavity of the portable light, the charging connector of the rechargeable power source will be aligned with an opening through an exterior wall of the portable light. The rechargeable power source 200 in combination with a portable light 100, 300, 400 which may comprise: a light body 120, 320, 420 having at least one exterior wall for defining at least a part of an internal cavity 122, 322, 422 configured to receive the rechargeable power source 200, wherein the internal cavity has a keying feature 126, 326, 426 that is complementary to the keying feature 230 of the rechargeable power source 200, the light body having an opening 124, 324, 424 through the exterior wall thereof that is in the same known predetermined location relative to the keying feature of the light body as is the charging connector of the rechargeable power source relative to the keying feature thereof; wherein when the rechargeable power source 200 is placed into the internal cavity of the light body 120, 320, 420 with the keying feature of the rechargeable power source engaging the keying feature of the internal cavity of the light body the charging connector of the rechargeable power source is aligned with the opening through the exterior wall of the light body; a light source 132, 332, 432 supported by the light body for producing light when energized; and an electrical switch 140, 340, 440 for selectively coupling the rechargeable power source to the light source for energizing the light source to produce light; whereby a connector of an external source of charging power can be connected through the opening through the exterior wall of the light body directly to the charging connector of the rechargeable power source for recharging the rechargeable power source.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "front," "back," "rear," "side," "end," "top," "bottom," "up," "down," "left," "right," "upward," "downward," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

As used herein, the term "plurality" means plural, two or greater in number of whatever the term pertains to, i.e. or more than one. Further, the term "predetermined" as used herein means determined in advance or before hand with respect to whatever the term pertains to. Either term may be used with respect to a physical object or thing and with respect to an intangible thing, e.g., a signal or data, and the like.

As used herein, the term "and/or" encompasses both the conjunctive and the disjunctive cases, so that a phrase in the form "A and/or B" encompasses "A" or "B" or "A and B" and a phrase in the form "A, B and/or C" includes "A," "B," "C," "A and B," "A and C," "B and C," and "A and B and C." In addition, the term "at least one of" one or more elements is intended to include one of any one of the elements, more than one of any of the elements, and two or more of the elements up to and including all of the elements, and so, e.g., phrases in the form "at least one of A, B and C" include "A," "B," "C," "A and B," "A and C," "B and C," and "A and B and C."

As used herein, the term "predetermined" means determined in advance and while that may include a fixed value, position, condition and/or limit, predetermined is not limited to a fixed value, position, condition and/or limit. A predetermined value, position, condition and/or limit may change or otherwise vary over time, over a sequence and/or over a randomized series of values, positions, conditions and/or limits.

A fastener as used herein may include any fastener or other fastening device that may be suitable for the described use, including threaded fasteners, e.g., bolts, screws and driven fasteners, as well as pins, rivets, nails, spikes, barbed fasteners, clips, clamps, nuts, speed nuts, cap nuts, acorn nuts, and the like. Where it is apparent that a fastener would be removable in the usual use of the example embodiment described herein, then removable fasteners would be preferred in such instances. A fastener may also include, where appropriate, other forms of fastening such as a formed head, e.g., a peened or heat formed head, a weld, e.g., a heat weld or ultrasonic weld, a braze, and adhesive, and the like.

While various operations, steps and/or elements of a process or method or operation may be described in an order or sequence, the operations, steps and/or elements do not need to be performed in that order or sequence, or in any particular order or sequence, unless expressly stated to require a particular order or sequence.

The terms power source and battery are used herein to refer to an electro-chemical device comprising one or more electro-chemical cells and/or fuel cells, and so a battery may include a single cell or plural cells, whether as individual units or as a packaged unit. A battery is one example of a type of an electrical power source suitable for a portable or other device. Such devices could include power sources including, but not limited to, fuel cells, super capacitors, solar cells, and the like. Any of the foregoing may be intended for a single use or for being rechargeable or for both, and/or plural ones thereof may be combined into a battery pack or battery assembly.

Various embodiments of a rechargeable source of electrical power that can be charged while inside a portable light include, e.g., a battery that may have one or more rechargeable battery cells, e.g., one, two, three, four, or five or more battery cells, as may be deemed suitable for any particular device. Such an example battery may employ various types and kinds of rechargeable battery chemistry types, e.g., nickel-metal-hydride (NiMH) or lithium-ion (Li-Ion) battery type, of a suitable number of cells and cell capacity for providing a desired operating time and/or lifetime for a particular device. Examples thereof may include a one to four cell NiMH battery typically producing about 1.2 to 4.8 volts in operation, or a one to two cell Lithium battery typically producing about 3.5 to 7 volts in operation, it being noted that the voltages produced thereby will be higher when charging and when approaching full charge and will be lower in discharge, particularly when providing higher current and when reaching a low level of charge, e.g., becoming discharged. For example, a typical lithium cell is charged to about 4.1-4.2 volts and includes circuitry to cut off discharge at about 3.0 volts to protect the cell.

While the present invention has been described in terms of the foregoing example embodiments, variations within the scope and spirit of the present invention as defined by the claims following will be apparent to those skilled in the art. For example, while the examples described herein are typically smaller lights that a user can carry in a hand or on his body, the invention may be employed in many different types and kinds of lights and other devices, whether or not easily portable, that include a rechargeable source of electrical power that has a charging port, e.g., an externally accessible charging connector, which can be accessed from outside the light or device for connecting an external source of charging power directly to the charging port of the source of electrical power while it is in the light or device.

While certain illustrated embodiments of example covers 160, 360, 460 for charging port 150, 350, 450 are illustrated as being captive on or attached to the light, e.g., attached by a fastener or encircling a part of the light to slide thereon, the cover may be separate from and not connected to the light or may be attached thereto by a lanyard or a tether or another retainer. For example, either of portable lights 100, 300 could employ a snap-in, snap-out cover similar to that described in relation to light 400.

While the example source of electrical power 200 is illustrated as having a generally symmetrical shape, e.g., a generally cylindrical shape, except for the keying feature 230 thereof, the power source 200 could be of any shape that would permit it to be placed into the light 100, 300, 400 in more than one orientation except for the keying action of its keying feature 230 with a complementary keying feature 126, 326, 426 of the light. For example, power source 200 could have a circular, rectangular, square, hexagonal, octagonal or other cross-sectional shape not defining a unique radial orientation except for the keying feature 230 thereof.

The terms engaging feature and keying feature are used interchangeably herein in relation to the features 126, 326, 426, 230 that determine the position of the power source 200 in the cavity 122, 322, 422 of the light body 120, 320, 420 such that the charging port or charging connector 250 of the power source 200 is aligned with the opening in the light body 120, 320, 420. A keying feature may be concave or convex, a recess or a projection, or any combination thereof.

Electrical power source 200 may have more than one charging port 250, e.g., each including an electrical connector of a different type. In such case, a light or device employing such power source 200 would have at least one opening in a predetermined location and of a size and shape that is compatible with the one charging port connector for which connection of an external source of charging power is desired, and the light may have more than one opening located in respective predetermined locations relative to the respective charging connectors of the power source 200 or power sources 200 for making connections to different charging sources.

Examples of alternative keying features can include, e.g.: a rib on the wall of the cavity of the light and a complementary groove or slot in the power source, or a groove or slot in the wall of the cavity of the light and a complementary rib on the power source, or a nub on the wall of the cavity of the light and a complementary groove or slot in the power source, or a groove or slot in the wall of the cavity of the light and a complementary nub on the power source, and the like.

Electrical contacts 172, 374, 474 that make electrical connection to terminals 240 of power source 240 may be fixed contacts, movable contacts, spring-loaded contacts, and the like.

Electrical switches 140, 340, 440 may be any suitable electrical switch, e.g., a snap-dome switch, a transfer switch, leaf contacts, and the like, and may be with or without a mechanical latch to retain the contacts thereof in an open or closed position and/or with or without an electronic "latch" that responds to a momentary opening or closing of a contact as if it is a continuous opening or closing thereof as is the case for a mechanical latch. In certain embodiments, e.g., where more than one switch may be provided, one switch may have a mechanical latch operation to have priority over another switch that is a momentary switch.

The present arrangement is suitable for use with other types and kinds of portable lights. For example, where the portable light is for mounting to a weapon and may be used with a remote switch, a mechanically or electronically latched switch may be provided on the light itself so as to be a primary switch having priority over a secondary, e.g., remote, switch.

While certain features may be described as a raised feature, e.g., a ridge, boss, flange, projection, detent, or other raised feature, such feature may be positively formed or may be what remains after a recessed feature, e.g., a groove, slot, hole, indentation, recess, detent, or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made. In addition, where a raised feature engages a recessed feature, such as for a keying feature, e.g., a shaped projection that engages a complementary shaped receptacle, the relative positions of the raised and recessed features may be interchanged or other wise modified.

Each of the U.S. Provisional applications, U.S. patent applications, and/or U.S. patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A rechargeable portable light comprising:

a light body having at least one exterior wall for defining at least a part of an internal cavity configured to receive a rechargeable power source, wherein the internal cavity has a keying feature and has an opening through the exterior wall that is in a predetermined location relative to the keying feature of the internal cavity;

a light source supported by the light body for producing light when energized;

a rechargeable power source having a charging connector in a side thereof and having a keying feature, wherein the keying feature thereof is in a predetermined location relative to the charging connector such that when the rechargeable power source is placed into the internal cavity of the light body with the keying feature of the rechargeable power source engaging the keying feature of the internal cavity the charging connector of the rechargeable power source is aligned with the opening through the exterior wall of the light body; and an electrical switch for selectively coupling the rechargeable power source to the light source for energizing the light source to produce light;

whereby a connector of an external source of charging power can be connected through the opening through the light body directly to the charging connector of the rechargeable power source for recharging the rechargeable power source.

2. The rechargeable portable light of claim 1 wherein the light body includes a cover for the internal cavity that is openable for placing the rechargeable power source into the internal cavity of the light body and for removing the rechargeable power source from the internal cavity thereof.

3. The rechargeable portable light of claim 2 wherein the keying feature of the internal cavity is at an end of the internal cavity that is distal from the cover for the internal cavity.

4. The rechargeable portable light of claim 1 wherein the keying feature of the internal cavity is one of a projection and a recess, and wherein the keying feature of the rechargeable power source is the other of a recess and a projection.

5. The rechargeable portable light of claim 1 wherein the keying feature of the internal cavity is proximate one of more electrical contacts in the internal cavity that make electrical connection to corresponding one or more electrical terminals of the rechargeable power source when the rechargeable power source is in the internal cavity with its keying feature engaging the keying feature of the internal cavity.

6. The rechargeable portable light of claim 5 wherein the keying feature of the internal cavity is:

a projection defining a convex surface proximate an end of the internal cavity; or a projection defining two planar surfaces having an intersection that is transverse to the internal cavity; or a recess defining a concave surface proximate an end of the internal cavity; or a recess defining two planar surfaces having an intersection that is transverse to the internal cavity and is proximate an end of the internal cavity.

7. The rechargeable portable light of claim 5 wherein the keying feature of the rechargeable power source is:

a projection defining a convex surface proximate an end of the rechargeable power source; or a projection defining two planar surfaces having an intersection that is transverse to the rechargeable power source; or a recess defining a concave surface proximate an end of the rechargeable power source; or a recess defining two planar surfaces having an intersection that is transverse to and is proximate an end of the rechargeable power source.

8. The rechargeable portable light of claim 5 wherein the one or more electrical terminals of the rechargeable power source include:

two terminals, each one on an opposite end of the rechargeable power source; or a central terminal and a concentric annular terminal on an end of the rechargeable power source; or two side by side terminals on the end of the rechargeable power source.

9. The rechargeable portable light of claim 1 further comprising a cover movable relative to the light body for covering and uncovering the opening through the exterior wall of the light body.

10. The rechargeable portable light of claim 9 wherein said movable cover includes:

an annular collar slidable along the light body for covering and uncovering the opening through the exterior wall of the light body; or an end cap slidable on the light body for covering and uncovering the opening through the exterior wall of the light body; or a cover movable toward and away from the light body for covering and uncovering the opening through the exterior wall of the light body; or a cover movable toward and away from the light body for covering and uncovering the opening through the exterior wall of the light body and of a size and shape to be retained in the opening through the exterior wall.

11. The rechargeable portable light of claim 1 wherein:

the rechargeable power source includes a rechargeable battery; or the rechargeable power source includes a rechargeable lithium battery.

12. The rechargeable portable light of claim 1 wherein the charging connector of the rechargeable power source includes: a coaxial connector, a USB connector, a mini-USB connector, a micro-USB connector, a USB-C connector, a FireWire connector, a Lightning connector, or a combination thereof.

13. The rechargeable portable light of claim 1 wherein the keying feature of the rechargeable power source is:

a recess defining a concave surface proximate an end of the rechargeable power source; or a recess defining a concave part of a cylindrical surface proximate an end of the rechargeable power source; or a recess defining two planar surfaces having an intersection that is transverse to a longer dimension of the rechargeable power source and is proximate an end of the rechargeable power source.

14. The rechargeable portable light of claim 1 wherein the rechargeable power source has a cylindrical case, wherein at least one of the one or more electrical terminals is on a circular terminal end of the power source case, wherein the charging connector is at a predetermined radial location and is a predetermined distance from the terminal end of the power source case.

15. The rechargeable portable light of claim 14 wherein the keying feature of the rechargeable power source is at a location that is about 180° radially from the charging connector and is proximate the circular terminal end.

16. The rechargeable portable light of claim 14 wherein the power source case includes a cylindrical main part which contains the rechargeable electrical cell and a cap therefor, wherein:

the cap encloses an electrical circuit board; or the cap has one or more recessed openings for the one or more electrical terminals; or;

the cap encloses an electrical circuit board and has one or more recessed openings for the one or more electrical terminals.

17. The rechargeable portable light of claim 1 wherein the rechargeable power source is cylindrical having one or more terminals at a terminal end thereof, and wherein the keying feature of the rechargeable power source is:

a recess defining a concave surface proximate the terminal end of the rechargeable power source; or a recess defining a concave part of a cylindrical surface proximate the terminal end of the rechargeable power source; or a recess defining two planar surfaces having an intersection that is transverse to a longer dimension of the rechargeable power source and is proximate the terminal end of the rechargeable power source.

18. A rechargeable portable light comprising:

a light body having at least one exterior wall for defining at least a part of an internal cavity configured to receive a rechargeable battery, wherein the internal cavity has a keying feature and has an opening through the exterior wall that is in a predetermined location relative to the keying feature of the internal cavity;

a light source supported by the light body for producing light when energized;

a rechargeable battery having a charging connector in a side thereof and having a keying feature, wherein the keying feature thereof is in a predetermined location relative to the charging connector such that when the rechargeable battery is placed into the internal cavity of the light body with the keying feature of the rechargeable battery engaging the keying feature of the internal cavity the charging connector of the rechargeable battery is aligned with the opening through the exterior wall of the light body; and an electrical switch for selectively coupling the rechargeable battery to the light source for energizing the light source to produce light;

whereby a connector of an external source of charging power can be connected through the opening through the light body directly to the charging connector of the rechargeable battery for recharging the rechargeable battery.

19. The rechargeable portable light of claim 18 wherein the light body includes a cover for the internal cavity that is openable for placing the rechargeable battery into the internal cavity of the light body and for removing the rechargeable battery from the internal cavity thereof.

20. The rechargeable portable light of claim 19 wherein the keying feature of the internal cavity is at an end of the internal cavity that is distal from the cover for the internal cavity.

21. The rechargeable portable light of claim 18 wherein the keying feature of the internal cavity is one of a projection and a recess, and wherein the keying feature of the rechargeable battery is the other of a recess and a projection.

22. The rechargeable portable light of claim 18 wherein the keying feature of the internal cavity is proximate one of more electrical contacts in the internal cavity that make electrical connection to corresponding one or more electrical terminals of the rechargeable battery when the rechargeable battery is in the internal cavity with its keying feature engaging the keying feature of the internal cavity.

23. The rechargeable portable light of claim 22 wherein the keying feature of the internal cavity is:

a projection defining a convex surface proximate an end of the internal cavity; or a projection defining two planar surfaces having an intersection that is transverse to the internal cavity; or a recess defining a concave surface proximate an end of the internal cavity; or a recess defining two planar surfaces having an intersection that is transverse to the internal cavity and is proximate an end of the internal cavity.

24. The rechargeable portable light of claim 22 wherein the keying feature of the rechargeable battery is:

a projection defining a convex surface proximate an end of the rechargeable battery; or a projection defining two planar surfaces having an intersection that is transverse to the rechargeable battery; or a recess defining a concave surface proximate an end of the rechargeable battery; or a recess defining two planar surfaces having an intersection that is transverse to and is proximate an end of the rechargeable battery.

25. The rechargeable portable light of claim 22 wherein the one or more electrical terminals of the rechargeable battery include:

two terminals, each one on an opposite end of the rechargeable battery; or a central terminal and a concentric annular terminal on an end of the rechargeable battery; or two side by side terminals on the end of the rechargeable battery.

26. The rechargeable portable light of claim 18 further comprising a cover movable relative to the light body for covering and uncovering the opening through the exterior wall of the light body.

27. The rechargeable portable light of claim 26 wherein said cover includes:

an annular collar slidable along the light body for covering and uncovering the opening through the exterior wall of the light body; or an end cap slidable on the light body for covering and uncovering the opening through the exterior wall of the light body; or a cover movable toward and away from the light body for covering and uncovering the opening through the exterior wall of the light body; or a cover movable toward and away from the light body for covering and uncovering the opening through the exterior wall of the light body and of a size and shape to be retained in the opening through the exterior wall.

28. The rechargeable portable light of claim 18 wherein the charging connector of the rechargeable battery includes: a coaxial connector, a USB connector, a mini-USB connector, a micro-USB connector, a USB-C connector, a FireWire connector, a Lightning connector, or a combination thereof.

29. The rechargeable portable light of claim 18 wherein the keying feature of the rechargeable battery has:

a recess defining a concave surface proximate an end of the rechargeable battery; or a recess defining two planar surfaces having an intersection that is transverse to a longer dimension of the rechargeable battery and is proximate an end of the rechargeable battery.

30. The rechargeable portable light of claim 18 wherein the rechargeable battery has a cylindrical case, wherein at least one of the one or more electrical terminals is on a circular terminal end of the battery case, wherein the charging connector is at a predetermined radial location and is a predetermined distance from the terminal end of the battery case.

31. The rechargeable portable light of claim 30 wherein the keying feature of the rechargeable battery is at a location that is about 180° radially from the charging connector and is proximate the circular terminal end.

32. The rechargeable portable light of claim 30 wherein the battery case includes a cylindrical main part which contains the rechargeable electrical cell and a cap therefor, wherein:

the cap encloses an electrical circuit board; or the cap has one or more recessed openings for the one or more electrical terminals; or the cap encloses an electrical circuit board and has one or more recessed openings for the one or more electrical terminals.

33. The rechargeable portable light of claim 18 wherein the rechargeable battery is cylindrical having one or more terminals at a terminal end thereof, and wherein the keying feature of the rechargeable battery is:

a recess defining a concave surface proximate the terminal end of the rechargeable battery; or a recess defining a concave part of a cylindrical surface proximate an end of the rechargeable power source; or a recess defining two planar surfaces having an intersection that is transverse to a longer dimension of the rechargeable battery and is proximate the terminal end of the rechargeable battery.

* * * * *